US005518327A

United States Patent [19]

Kasai

[11] Patent Number: 5,518,327

[45] Date of Patent: May 21, 1996

[54] WIRE MOTION DETECTING APPARATUS FOR WIRE DOT HEAD AND WIRE DOT IMPACT PRINTER APPARATUS THEREWITH

[75] Inventor: Tadashi Kasai, Tokyo, Japan

[73] Assignee: Oki Electric Industry Co., Ltd., Tokyo, Japan

[21] Appl. No.: 327,665

[22] Filed: Oct. 21, 1994

[30] Foreign Application Priority Data

Oct. 22, 1993 [JP] Japan ..... 5-256197

[51] Int. Cl.[6] ..... B41J 9/00; B41J 9/52

[52] U.S. Cl. ..... 400/157.2; 400/166

[58] Field of Search ..... 400/157.2, 157.3, 400/166, 167, 124.04–124.07

[56] References Cited

U.S. PATENT DOCUMENTS

| | | | |
|---|---|---|---|
| 5,039,238 | 8/1991 | Kikuchi | 400/157.3 |
| 5,201,876 | 4/1993 | Stengel | 400/166 |
| 5,312,193 | 5/1994 | Kringe | 400/322 |
| 5,330,277 | 7/1994 | Kasai | 400/157.3 |
| 5,439,302 | 8/1995 | Andou et al. | 400/157.3 |

FOREIGN PATENT DOCUMENTS

| | | | |
|---|---|---|---|
| 699640 | 4/1994 | Japan | 400/157.3 |

*Primary Examiner*—Edgar S. Burr
*Assistant Examiner*—Steven S. Kelley
*Attorney, Agent, or Firm*—Spencer & Frank

[57] ABSTRACT

The wire motion detecting apparatus according to the present invention comprises a velocity detecting portion for detecting the velocity of a printing wire, a comparator output signal generating portion for generating a first comparator output signal CMP and a second comparator output signal CMPR corresponding to the detected velocity, a first counter 101 for measuring a motion time $T_S$ for the printing wire, a second counter 102 for measuring a print time $T_P$ for the printing wire, and a third counter 103 for measuring a return time $T_R$ for the printing wire. When the signal level of the first comparator output signal CMP is repeatedly changed between a high level and a low level, the first counter 101 stops counting. Even if an armature is rebounded, the first counter 101 does not resume counting.

12 Claims, 16 Drawing Sheets

WIRE MOTION DETECTING APPARATUS FOR WIRE DOT HEAD AND WIRE DOT IMPACT PRINTER APPARATUS THEREWITH

REFERENCE TO RELATED APPLICATION

This application claims the priority right under 35 U.S.C. 119 of Japanese Patent Application No. Hei 05-265197 filed on Oct. 22, 1993, the entire disclosure of which is incorporated herein by reference.

BACKGROUND OF THE INVENTION

1. Field of the Invention

The present invention relates to a wire dot impact printer apparatus, in particular, a wire motion detecting apparatus for a wire dot head.

2. Description of the Related Art

In a wire dot impact printer apparatus, a wire dot head is disposed opposite to a platen through an ink ribbon and a printing medium. A printing wire is banged on the printing medium through the ink ribbon.

With a wire motion detecting apparatus that detects the motion of the printing wire dot head, the wire dot impact printer apparatus prints data on various printing mediums. In reality, in the printer apparatus, the thickness of a printing medium for use (or the number of copy papers) is detected by the wire motion detecting apparatus and a sensor circuit of a print time detecting portion. When the thickness of the printing paper is changed, the distance between the forward edge of the wire dot head and the printing medium (this distance is referred to as head gap) is optimally adjusted.

However, in the wire motion detecting apparatus for the conventional wire dot head, if a velocity wave form $V_1$ is abnormal or if a sensor failure takes place, a motion time $T_S$, a print time $T_P$, and a return time $T_R$ cannot be precisely measured.

SUMMARY OF THE INVENTION

An object of the present invention is to solve the above-mentioned problem of a wire motion detecting apparatus for a wire dot head according to the related art reference and to provide both a wire motion detecting apparatus for a wire dot head that can precisely obtain a motion time, a print time, and a return time upon occurrences of an abnormal velocity wave form or a sensor failure and a wire dot impact printer apparatus for use with the wire motion detecting apparatus for the wire dot head.

A first aspect of the present invention is a wire motion detecting apparatus for a wire dot head, comprising a first counter for inputting a printing trigger signal and a first comparator output signal that is obtained by comparing a velocity wave form of the printing wire of the printer head with a first reference voltage and for measuring a motion time of a printing wire corresponding to the printing trigger signal and the first comparator output signal, a second counter for measuring a print time of the printing wire corresponding to the first comparator output signal, a third counter for measuring a return time of the printing wire corresponding to the first comparator output signal and a second comparator output signal that is obtained by comparing the velocity wave form of the printing wire of the printer head with a second reference voltage, and a count portion for causing the first counter to stop counting when the signal level of the first comparator output signal is repeatedly changed between a high level and a low level.

A second aspect of the present invention is a wire motion detecting apparatus for a wire dot head, comprising a first counter for inputting a printing trigger signal and a first comparator output signal that is obtained by comparing a velocity wave form of the printing wire of the printer head with a first reference voltage and for measuring a motion time of a printing wire corresponding to the printing trigger signal and the first comparator output signal, a second counter for measuring a print time of the printing wire corresponding to the first comparator output signal, a third counter for measuring a return time of the printing wire corresponding to the first comparator output signal and a second comparator output signal that is obtained by comparing the velocity wave form of the printing wire of the printer head with a second reference voltage, and a sensor failure detecting portion for determining that the count value of at least one of the first counter and the second counter becomes maximum and for causing the counter to stop counting when at least one of the first comparator output signal and the second comparator output signal is not generated.

A third aspect of the present invention is a wire motion detecting apparatus for a wire dot head, comprising a first counter for inputting a printing trigger signal and a first comparator output signal that is obtained by comparing a velocity wave form of the printing wire of the printer head with a first reference voltage and for measuring a motion time of a printing wire corresponding to the printing trigger signal and the first comparator output signal, a second counter for measuring a print time of the printing wire corresponding to the first comparator output signal, a third counter for measuring a return time of the printing wire corresponding to the first comparator output signal and a second comparator output signal that is obtained by comparing the velocity wave form of the printing wire of the printer head with a second reference voltage, and a count repeating portion for resuming counting of the first counter and the second counter when the signal level of the first comparator output signal is repeatedly changed between a high level and a low level until the third counter measures a return time of the printing wire.

According to the first aspect of the present invention, the wire motion detecting apparatus for the wire dot head comprises a velocity detecting means for detecting the velocity of a printing wire, a comparator output signal generating means for comparing a velocity wave form of the detected velocity with a reference voltage and for generating a first comparator output signal and a second comparator output signal, a first counter for measuring the motion time of the printing wire corresponding to a printing trigger signal and the first comparator output signal, a second counter for measuring the print time of the printing wire corresponding to the first comparator output signal and the second comparator output signal, and a third counter for measuring the return time of the printing wire corresponding to the second comparator output signal.

The wire motion detecting apparatus of the first aspect of the present invention further comprises a count stopping means for stopping the counting of the first counter when the signal level of the first comparator output signal is repeatedly changed between a high level and a low level.

After the printing wire is being retreated, an armature is attracted by a core and thereby rebounded. In this case, even if the rebounding of the armature causes the signal level of the first comparator output signal to be changed, the first counter does not start counting.

According to the second aspect of the present invention, the wire motion detecting apparatus for the wire dot head comprises a velocity detecting means for detecting the velocity of a printing wire, a comparator output signal generating means for comparing a velocity wave form of the detected velocity with a reference voltage and for generating a first comparator output signal and a second comparator output signal, a first counter for measuring the motion time of the printing wire corresponding to a printing trigger signal and the first comparator output signal, a second counter for measuring the print time of the printing wire corresponding to the first comparator output signal and the second comparator output signal, and a third counter for measuring the return time of the printing wire corresponding to the second comparator output signal.

The wire motion detecting apparatus of the second aspect further comprises a sensor failure detecting means for causing the count value of at least one of the counters to become maximum when at least one of the first comparator output signal and the second comparator output signal cannot be generated.

When a sensor failure takes place, even after a predetermined time period has elapsed, the signal level of the first comparator output signal is not changed. Thus, the counter value of the first counter becomes maximum and a carry signal is output from a terminal.

According to the third aspect of the present invention, the wire motion detecting apparatus for the wire dot head comprises a velocity detecting means for detecting the velocity of a printing wire, a comparator output signal generating means for comparing a velocity wave form of the detected velocity with a reference voltage and for generating a first comparator output signal and a second comparator output signal, a first counter for measuring the motion time of the printing wire corresponding to a printing trigger signal and the first comparator output signal, a second counter for measuring the print time of the printing wire corresponding to the first comparator output signal and the second comparator output signal, and a third counter for measuring the return time of the printing wire corresponding to the second comparator output signal.

The wire motion detecting apparatus of the third aspect further comprises a count repeating means for causing the first counter and the second counter to resume counting when the signal level of the first comparator output signal is repeatedly changed between a high level and a low level until the return time of the printing wire is measured by the third counter.

Thus, when a noise takes place in the velocity wave form and thereby the signal level of the first comparator output signal is repeatedly changed between a high level and a low level, the counting of the first counter and the second counter is resumed. When the signal level of the first comparator output signal is changed between a high level and a low level with a normal sensor timing, the first counter stops counting and the second counter starts counting.

These and other objects, features and advantages of the present invention will become more apparent in light of the following detailed description of a best mode embodiment thereof, as illustrated in the accompanying drawings.

Description of Preferred Embodiments

Next, with reference to the accompanying drawings, a wire motion detecting apparatus for a wire dot head and a wire dot impact printer apparatus therewith according to embodiments of the present invention will be described.

Figure 2:
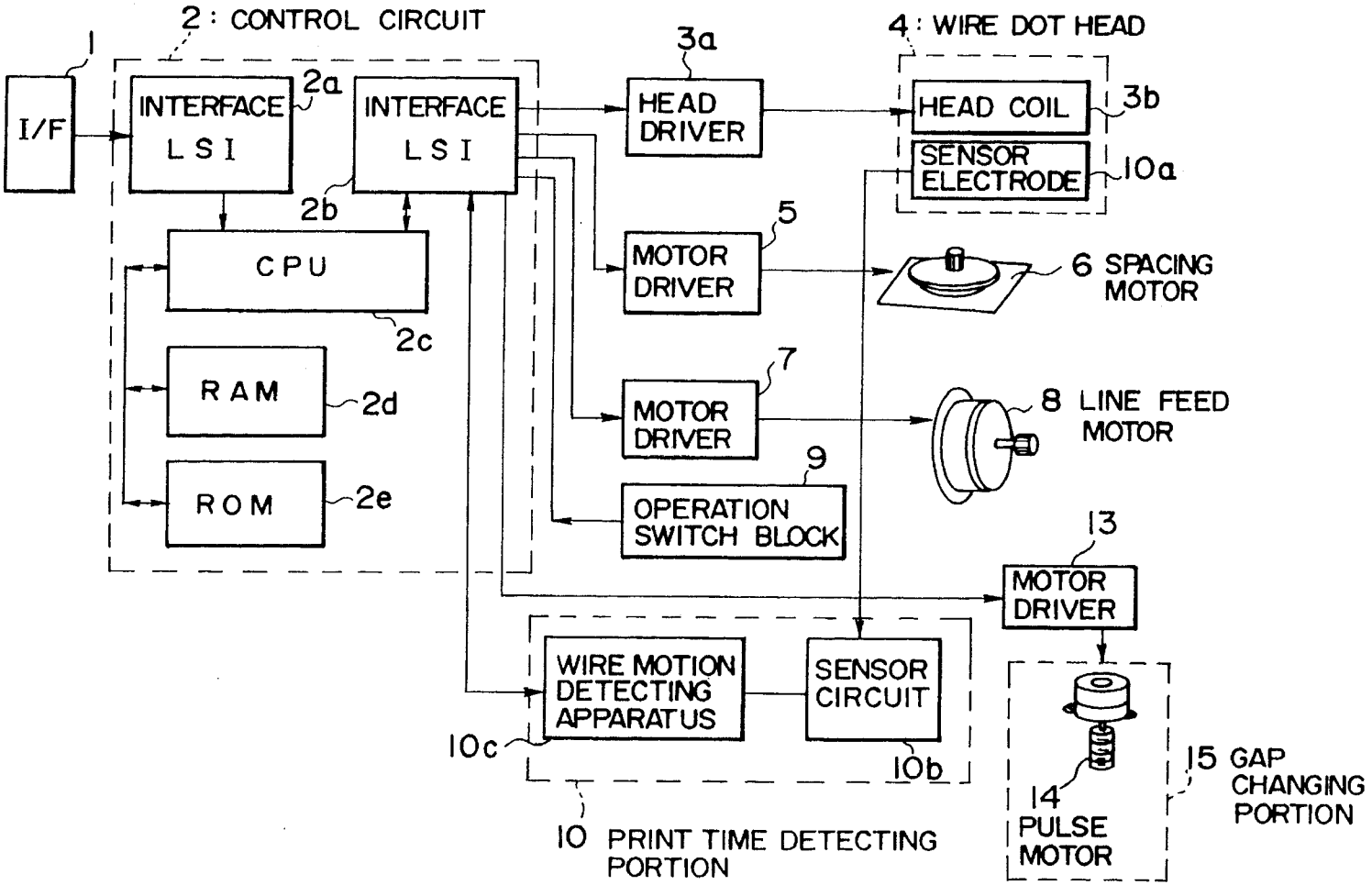
FIG. 2 is a block diagram showing a wire dot impact printing apparatus for use with the wire motion detecting apparatus for the wire dot head according to an embodiment of the present invention.
Figure 3:
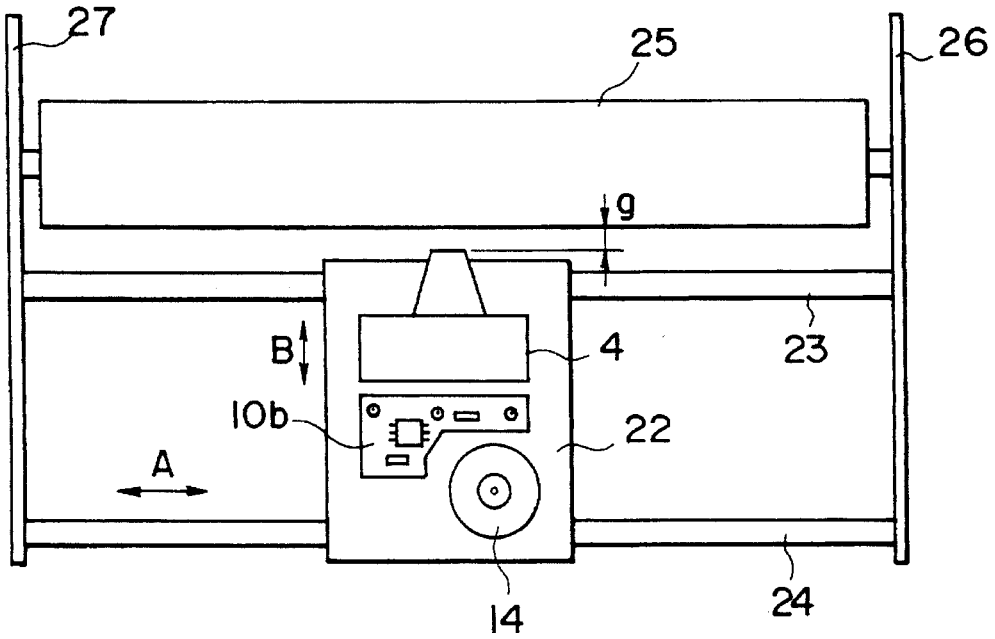
FIG. 3 is a plan view for explaining a gap changing portion of the wire dot impact printer apparatus according to the present invention.
Figure 4:
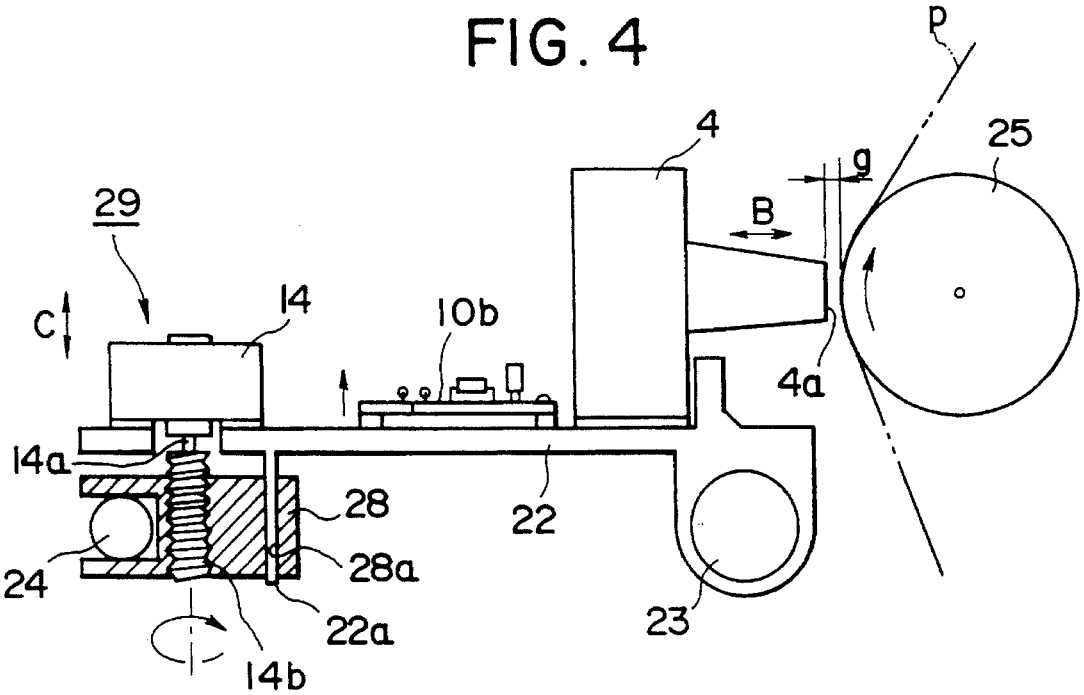
FIG. 4 is a side view for explaining the gap changing portion of the wire dot impact printer apparatus according to the present invention.

FIG. 2 is a block diagram showing a wire dot impact printer apparatus according to an embodiment of the present invention. FIG. 3 is a plan view showing a gap changing portion of the wire dot impact printer apparatus according to the embodiment. FIG. 4 is a side view showing the gap changing means of the wire dot impact printer apparatus according to the embodiment.

In FIG. 2, reference numeral 1 is an interface (I/F) that inputs printing data to the wire dot impact printer apparatus. Reference numeral 2 is a control circuit that controls the entire operation of the wire dot impact printer apparatus. Reference numeral 3*a* is a head driver. Reference numeral 3*b* is a head coil. Reference numeral 4 is a wire dot head. Reference numeral 5 is a spacing motor driver. Reference numeral 6 is a spacing motor. Reference numeral 7 is a line feed motor driver. Reference numeral 8 is a line feed motor. Reference numeral 9 is an operation switch block. Reference numeral 10*a* is a sensor electrode. Reference numeral 10*b* is a capacitance sensor circuit (hereinafter referred to as sensor circuit). Reference numeral 10 is a print time detecting portion that detects a print time of a printing wire. The print time detecting portion 10 is constructed of the sensor electrode 10*a*, the sensor circuit 10*b*, and a wire motion detecting apparatus 10*c*. Reference numeral 13 is a pulse motor driver. Reference numeral 14 is a pulse motor. Reference numeral 15 is a gap changing portion that changes a head gap. The gap changing portion 15 is a pulse motor 14.

The control circuit 2 comprises input/output interfaces LSIs 2*a* and 2*b*, a CPU 2*c*, a RAM 2*d*, and a ROM 2*e*. The CPU 2*c* performs various processes such as a process that obtains the head gap corresponding to a detected print time. The RAM 2*d* stores printing data and processes internal data. The ROM 2*e* stores control programs and printing fonts (that represent shapes of letters).

In FIGS. 3 and 4, reference numeral 4 is a wire dot head. Reference numeral 22 is a carriage that supports the wire dot head 4. Reference numerals 23 and 24 are guide shafts that support the carriage 22 in such a manner that the carriage 22 is moved in the directions of arrow A of FIG. 3. Reference numeral 25 is a platen that carries a printing medium P. Reference numerals 26 and 27 are side frames that support the guide shafts 23 and 24.

The carriage 22 is moved by the spacing motor 6 (see FIG. 2) in the directions of the arrow A and thereby the wire dot head 4 is moved in the lateral (horizontal) direction of the printing medium P. The platen 25 is rotated by the line feed motor 8 and thereby the printing medium P is moved in the longitudinal (vertical) direction that is perpendicular to the lateral direction.

When data is printed, the wire dot head 4 is moved in the lateral direction of the printing medium P at a predetermined velocity. A printing wire (not shown) is banged on a printing position of the printing medium P through for example an ink ribbon (not shown). When the wire dot head 4 reaches the trailing edge of the printing medium P and the printing for one line is completed, the wire dot head is moved back to the initial position. At this point, the platen 25 is rotated so that the printing medium P is moved for one line in the longitudinal direction thereof. Thereafter, the printing of the next line is started.

Although the carriage 22 is moved along the two guide shafts 23 and 24, a rear portion (left side of FIG. 4) of the carriage 22 is supported by the guide shaft 24 through a height adjusting mechanism 29. In other words, the pulse motor 14 is secured to the rear portion of the carriage 22. A screw gear 14*b* is directly connected to a rotating shaft 14*a* of the pulse motor 14. On the lower surface of the rear portion of the carriage 22, a guide pin 22*a* protrudes. The guide pin 22*a* is inserted into a guide hole 28*a* of a slider 28 that is movably supported along the guide shaft 24 in such a manner that the guide pin 22*a* is vertically slidable in the guide hole 28*a*. A gear (not shown) is formed on the slider 28. The gear is engaged with a screw gear 14*b*.

Thus, the carriage 22 is supported by the guide shaft 24 through the slider 28, the screw gear 14*b*, the rotating shaft 14*a*, and the pulse motor 14. The rear portion of the carrier 22 is vertically moved by the pulse motor 14 in the direction of arrow C (the direction of the guide pin 22*a* guided by the guide hole 28*a*) and thereby the carriage 22 is rotated about the guide shaft 23. Thus, the wire dot head 4 is moved in the direction of arrow B. Consequently, the head gap g that is formed between the forward edge of the wire head 4 and the printing medium P can be changed. The gap changing portion 15 may be for example a mechanism that moves the platen 25. Reference numeral 4*a* is the forward edge of the wire dot head 4. Reference numeral 10*b* is a sensor circuit.

Next, the print time detecting portion 10 will be described.

Figure 5:
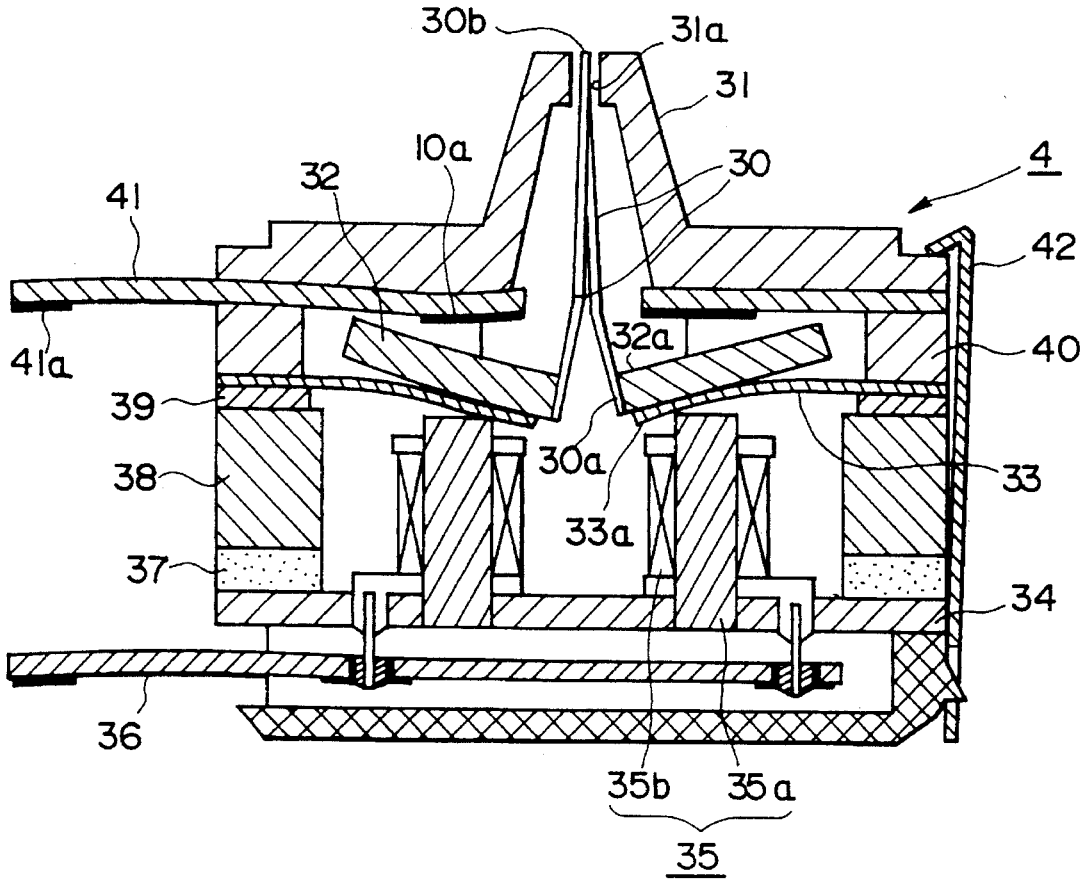
FIG. 5 is a vertical sectional view showing the wire dot head of the wire dot impact printer apparatus according to the present invention.
Figure 6:
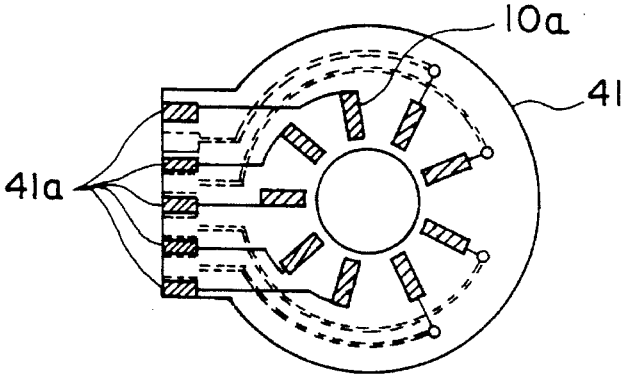
FIG. 6 is a plan view showing a printed circuit board of the wire dot head of the wire dot impact printer apparatus according to the present invention.
Figure 7:
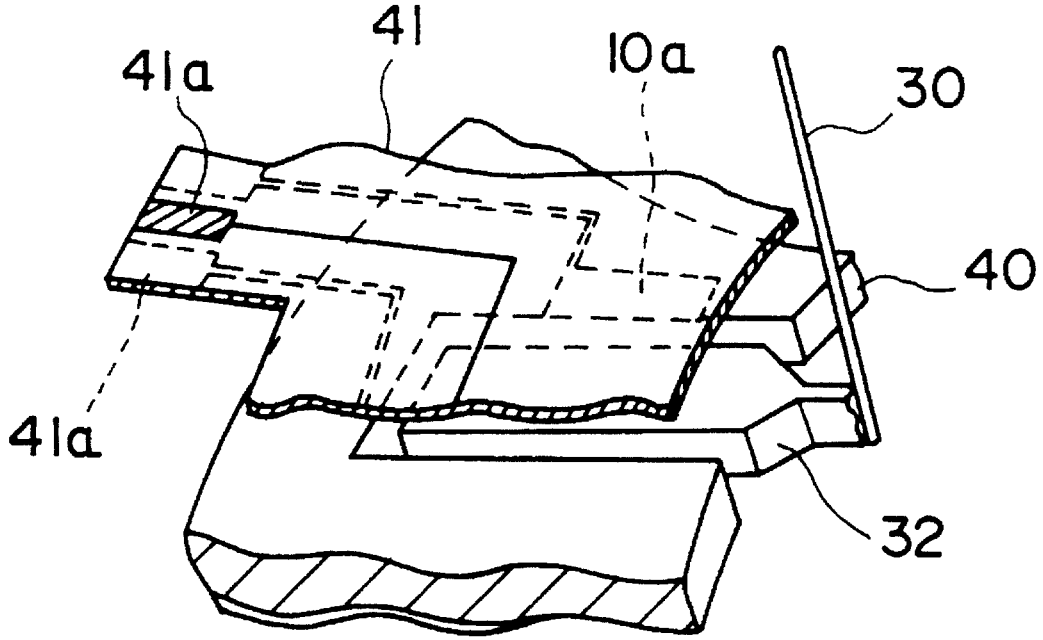
FIG. 7 is a perspective view showing principal portions of the printed circuit board of FIG. 6.

FIG. 5 is a vertical sectional view showing the wire dot head. FIG. 6 is a plan view showing a printed circuit board. FIG. 7 is a perspective view showing principal portions of the printed circuit board.

In FIG. 5, reference numeral 30 is a plurality of printing wires disposed in the wire dot head 4 (in FIG. 5, only two printing wires are shown). Reference numeral 31 is a front cover that has a guide hole 31*a*. The guide hole 31*a* guides the printing wires 30. Reference numeral 32 is an armature composed of a magnetic substance. Reference numeral 33 is a leaf spring that supports the armature 32. Reference numeral 34 is a base plate. Reference numeral 35 is an electromagnet where a head coil 35*b* is wound around a core 35*a*. Reference numeral 36 is a printed circuit board that has printed lines and connector terminals (not shown) that supply a current to the electromagnet 35. Reference numeral 37 is a permanent magnet. Reference numeral 38 is a base plate. Reference numeral 39 is a spacer. Reference numeral 40 is a yoke. Reference numeral 41 is a printed circuit board. Reference numeral 42 is a clamp.

The clamp 42 integrally clamps the base plate 34, the permanent magnet 37, the base plate 38, the spacer 39, the leaf spring 33, the yoke 40, the printed circuit board 41, and the front cover 31.

The armature 32 is supported on a free end 33*a* side of the leaf spring 33. A base portion 30*a* of each of the printing wires 30 is secured to an edge 32*a* of the armature 32. An edge 30*b* of each of the printing wires 30 is guided to a guide hole 31*a* of the front cover 1 so that the edge 30*b* is banged on the printing medium P (see FIG. 4).

As shown in FIGS. 6 and 7, a sensor electrode 10*a* composed of a copper foil pattern is formed at a position corresponding to the armature 32 of the printed circuit board 41. The sensor electrode 10*a* is connected to a connector terminal 41*a* disposed at an edge portion of the printed circuit board 41. The printed circuit board 41 is coated with an insulation film so as to insulate the printed circuit board 41 from the yoke 40. Thus, a capacitance takes place between the sensor electrode 10*a* and the armature 32. The capacitance is reversely proportional to the distance between the sensor electrode 10*a* and the armature 32. In other words, the capacitance is proportional to the distance between the sensor electrode 10*a* and the armature 32.

When the head coil 35*b* is not energized, the armature 32 is attracted on the base plate 34 side (the lower direction of the drawing) by an attracting force of the permanent magnet 37 against a restoring force of the leaf spring 33. In this condition, when the head coil 35*b* is energized, the magnetic flux of the permanent magnet 37 is offset by the magnetic flux of the electromagnet 35. Thus, the armature 32 is released from the attracting force of the permanent magnet 37 and moved on the front cover 31 side (the upper direction of the drawing). As the armature 32 moves, the printing wires 30 protrude from the guide hole 31*a* and bang the printing medium P. Thus, the printing is preformed.

The yoke 40 constructs a part of a magnetic circuit formed by the electromagnetic 35 and prevents mutual interference of the sensor electrode 10a*a*.

Figure 8:
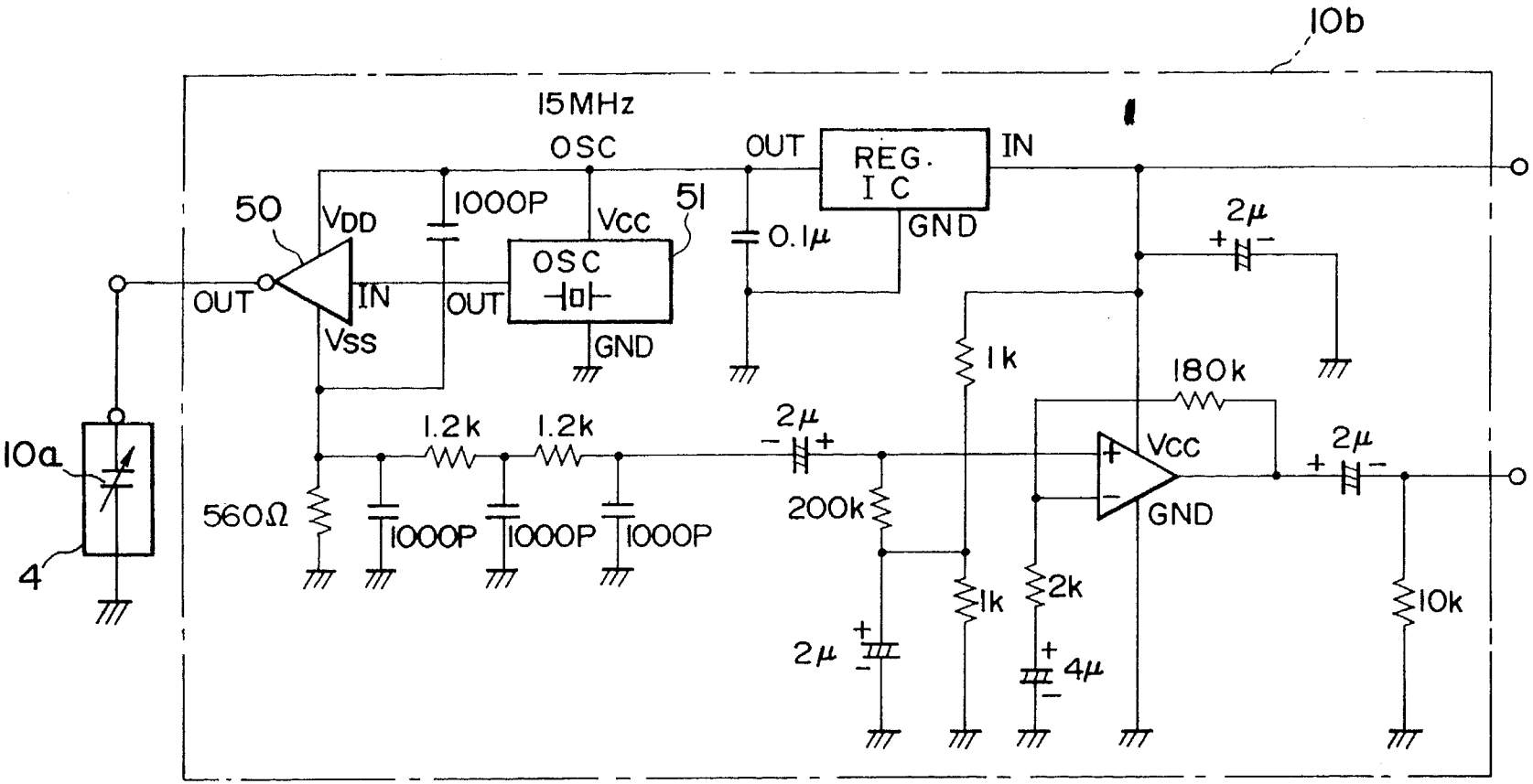
FIG. 8 is a circuit diagram showing a sensor circuit of the wire motion detecting apparatus for the wire dot head of the wire dot impact printer apparatus according to the present invention.
Figure 9:
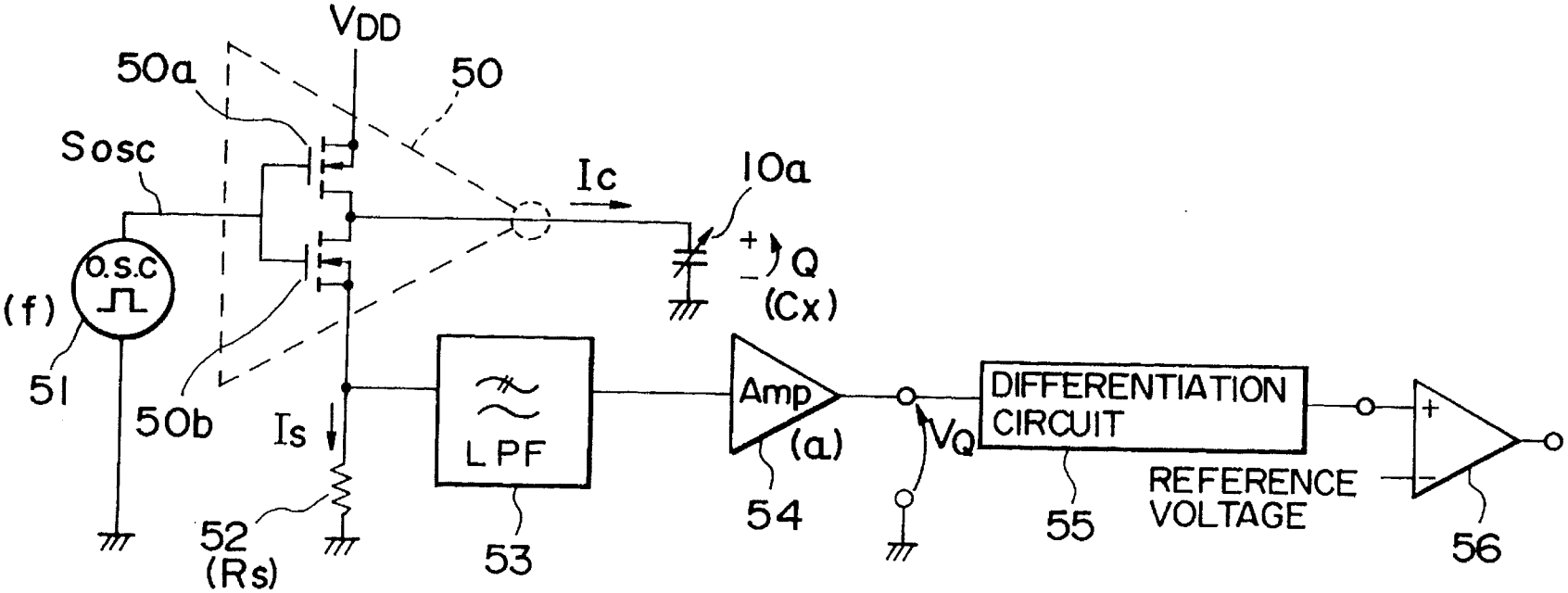
FIG. 9 is a theoretical circuit diagram showing the sensor circuit of FIG. 8.
Figure 10:
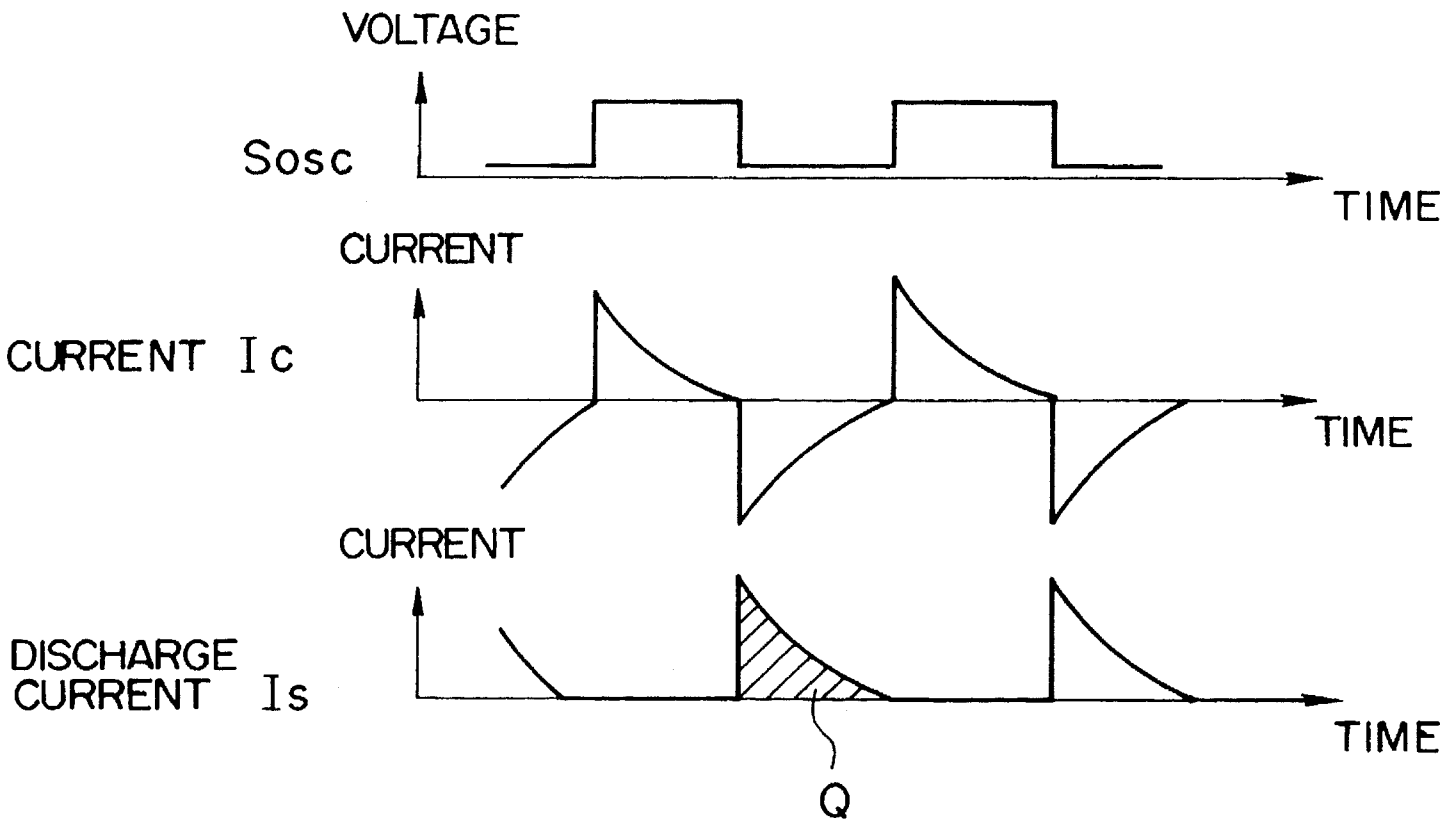
FIG. 10 is a schematic diagram showing operational wave forms of the sensor circuit of FIG. 8.

FIG. 8 is a circuit diagram showing the sensor circuit 10*b* of the wire motion detecting apparatus 10*c* for the wire dot head according to the embodiment of the present invention. FIG. 9 is a theoretical circuit diagram showing the sensor circuit 10*b*. FIG. 10 is a schematic diagram showing operational wave forms of a sensor circuit of the wire motion detecting apparatus for the wire dot head of FIG. 8. In FIG. 10, the horizontal axis represents time and the vertical axis represents a voltage of a square wave signal $S_{OSC}$, a current $I_C$, and a discharge current $I_S$.

In FIGS. 8 and 9, reference numeral 4 is a wire dot head. Reference numeral 10*a* is a sensor electrode. Reference numeral 50 is a digital IC. Reference numerals 50*a* and 50*b* are MOS type FETs (Field Effect Transistors) of internal equivalent circuits. Reference numeral 51 is an oscillator. Reference numeral 52 is a resistor. Reference numeral 53 is an integrator. Reference numeral 54 is an amplifier. Reference numeral 55 is a differentiation circuit. Reference numeral 56 is a comparator.

In the sensor circuit 10*b* (see FIG. 8), an output terminal of the digital IC 50 is connected to a sensor electrode 10*a*. An input terminal of the digital IC 50 is connected to the oscillator 51. When a square wave signal $S_{OSC}$ shown in FIG. 10 is supplied from the oscillator 51 to the digital IC 50, a current $I_C$ flows at the output terminal of the digital IC 50 as shown in FIG. 9. Since the MOS type FETs 50*a* and 50*b* receive the square wave signal $S_{OSC}$ and are alternately turned on and off, the current IC becomes a charge current and a discharge current of the sensor electrode 10*a*. The charge current Is flows to the ground through the MOS type FET 50*b* and the resistor 52. The amount of charge Q charged to the sensor electrode 10*a* is almost equivalent to the value where the discharge current Is is integrated for one period.

The capacitance of the sensor electrode 10a is denoted by $C_X$, the oscillating frequency of the oscillator 51 is denoted by f, the resistance of the resistor 52 is denoted by $R_S$, the amplifying factor of the amplifier 54 is denoted by a, and the power supply voltage is denoted by $V_{DD}$. In this case, the mean value of the discharge current $I_S$ is given by the following equation.

$$f \times Q = f \times C_X \times V_{DD}$$

An output voltage $V_Q$ of the amplifier 54 is given by the following equation.

$$V_Q = C_X \times R_S \times a \times f \times V_{DD}$$

Thus, the output voltage $V_Q$ that is proportional to the capacitance $C_X$ is obtained. The output voltage $V_Q$ is sent to the differentiation circuit 55. The differentiation circuit 55 outputs as a velocity wave shape a voltage that is proportional to the velocity v of the printing wires 30 (see FIG. 30). The comparator 56 compares the velocity wave form with the reference voltage. Thus, the sensor circuit 10*b* outputs the print time $T_P$ for which the printing wires 30 are banged on the printing medium P (see FIG. 4). In reality, the amplifier 54 is an AC amplifier. An offset (DC component) that is a distributed capacitance other than the capacitance the sensor electrode 10*a* is discarded. In other words, only with the displacement amount of the armature 32, the print time Tp is output.

Figure 11:
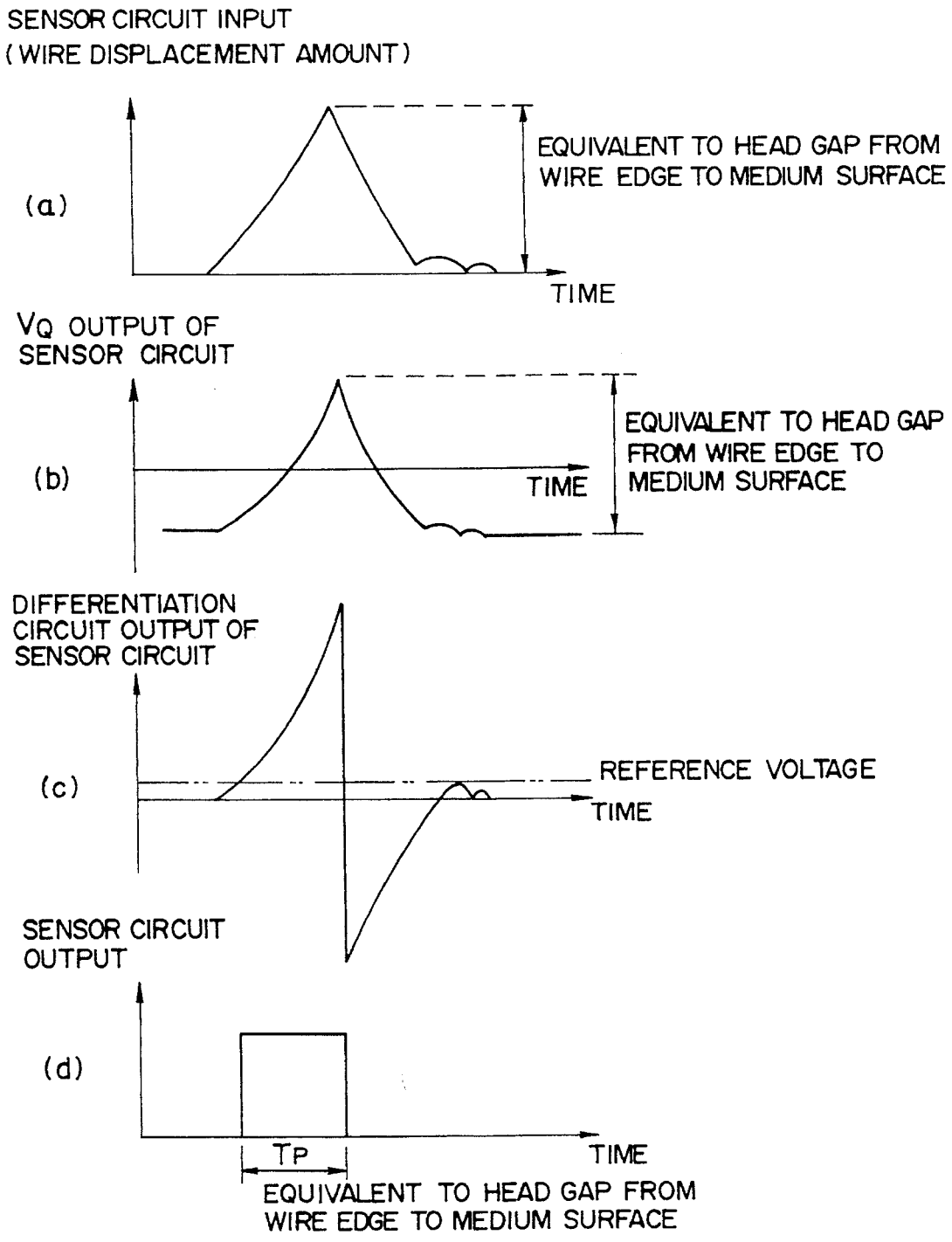
FIG. 11 is a schematic diagram showing input/output wave forms of the sensor circuit of FIG. 8.

FIG. 11 is a schematic diagram showing input and output wave forms of the sensor circuit 10*b* of the wire motion detecting apparatus for the wire dot head of FIG. 8.

FIG. 11(*a*) shows an output wave form of the sensor electrode 10*a* (see FIG. 2). FIG. 11(*b*) shows an output voltage $V_Q$ Of the amplifier 54 (see FIG. 9) of the sensor circuit 10*b*. FIG. 11(*c*) shows an output signal wave form of the differentiation circuit 55. FIG. 11(*d*) shows an output wave form, which is the print time Tp, of the comparator 56.

The print time $T_P$ is input to the CPU 2*c* through the interface LSI 2*b*. The difference between the detected print time $T_P$ and a predetermined standard print time $T_S$ is obtained. The predetermined standard print time $T_S$ is for example the print time for which data is printed on the printing medium P (see FIG. 4) having a thickness of 0.08 mm through an ink ribbon (not shown) with a reference head gap $g_A$ of 0.5 mm. It is experimentally known that the difference of 3 μsec at the print time $T_P$ is equivalent to the head gap g of 0.01 mm. With such experimental data, the head gap g to the printing medium P is calculated. Next, the amount of movement of the wire dot head 4 is calculated so that the head gap g becomes a correct value $g_R$ By the gap changing portion 15 shown in FIGS. 3 and 4, the wire dot head 4 is moved for the calculated amount of moving so as to adjust the head gap g.

When the reference voltage $V_{REFR}$ is set to a value lower than the start value (0) of the velocity wave form $V_1$, a return time $T_R$ can be detected. The return time $T_R$ is a time period after data is printed until the armature 32 (see FIG. 5) is attracted by the core 35*a* and thereby the printing wire 30 is returned to the original position.

Figure 12:
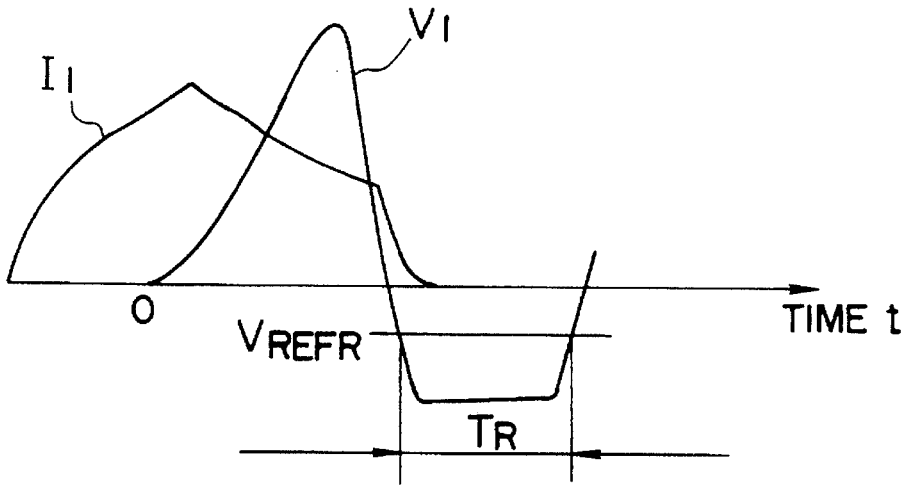
FIG. 12 is a schematic diagram showing wave forms of the wire motion detecting apparatus for the wire dot head.

FIG. 12 is a schematic diagram showing a wave form of a wire motion detecting apparatus for another wire dot head.

In FIG. 12, reference letter $I_1$ is a current wave form of a current that flows in the head coil 35*b* (see FIG. 5). Reference letter $V_1$ is a velocity wave form of the printing wires 30. Reference letter $V_{REFR}$ is a reference voltage for slicing the velocity wave form $V_1$ at which the armature 32 is attracted by the core 35*a*. Reference letter $T_R$ is a return time.

In this case, since the absolute value of the velocity wave form $V_1$ of the return time $T_R$ is almost constant, the head gap g can be precisely adjusted.

When the reference voltage $V_{REF}$ is set to a value higher than the start value (0) of the velocity wave form $V_1$, the floating of the printing medium P (see FIG. 4) can be detected.

Figure 13:
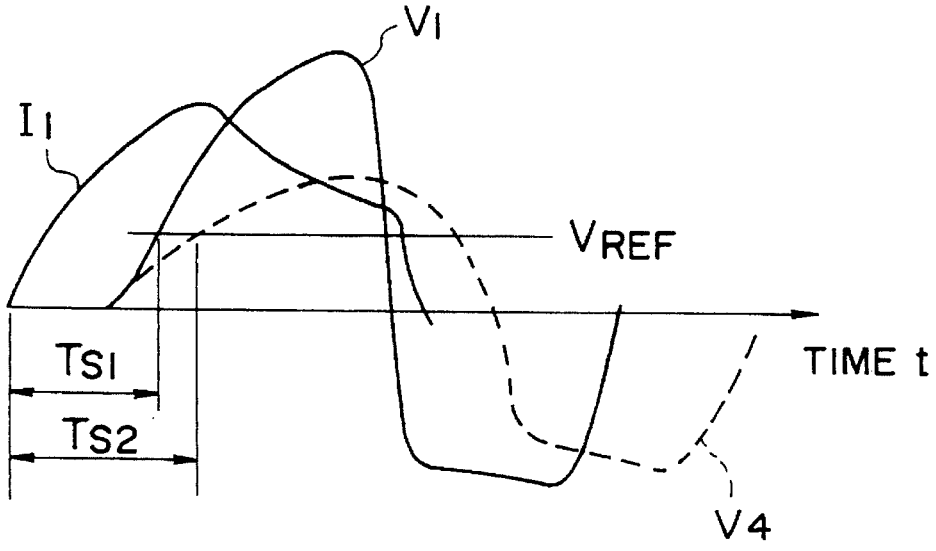
FIG. 13 is a schematic diagram showing wave forms of the wire motion detecting apparatus for the wire dot head.

FIG. 13 is a schematic diagram showing wave forms of a wire motion detecting apparatus for a further wire dot head.

In FIG. 13, reference letter $I_1$ is a current wave form of a current that flows in the head coil 35*b* (see FIG. 5). Reference letter $V_1$ is a velocity wave form of the printing wires 30 before the printing medium P (see FIG. 4) is changed. Reference letter $V_4$ is a velocity wave form of the printing wires 30 in the case that the printing medium P is hard and floating rather than being wound around the platen 25. Reference letter $V_{REG}$ is a reference voltage. Reference letter $T_{S1}$ is the value of the motion time $T_S$ after a printing trigger signal is generated and thereby a drive voltage is applied until the velocity wave form $V_1$ of the printing wire 30 intersects with the reference voltage $V_{REF}$. Reference letter $T_{S2}$ is the value of the motion time $T_S$ after a printing trigger signal is generated and thereby a drive voltage is applied until the velocity wave form $V_4$ of the printing wire 30 intersects with the reference voltage $V_{REF}$.

Thus, with the difference between values $T_{S1}$ and $T_{S2}$ of the motion time $T_S$, the floating of the printing medium P can be detected. Next, the calculating method of the motion time $T_S$, the print time $T_P$, and the return time $T_R$ will be described.

Figure 1:
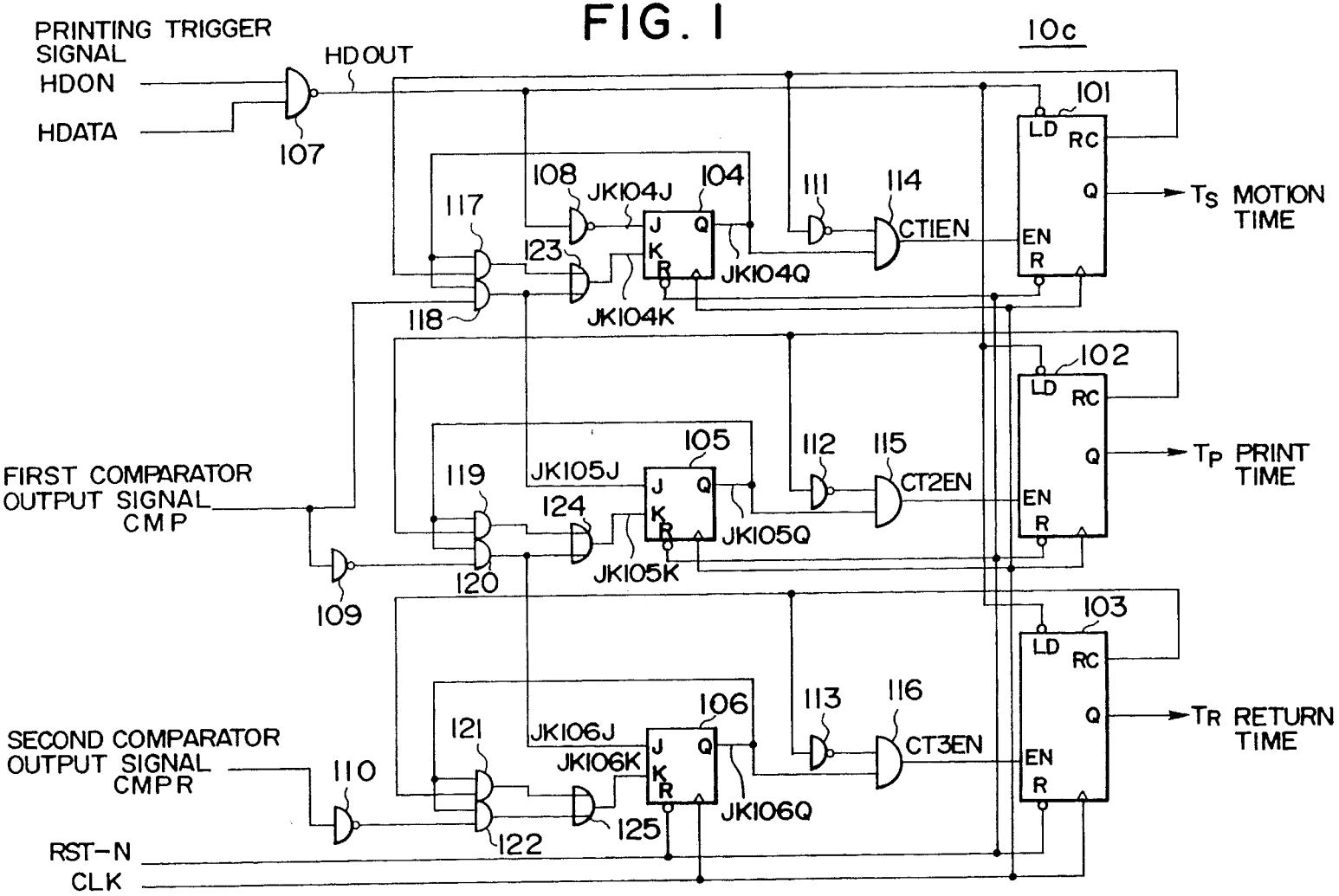
FIG. 1 is a block diagram showing a wire motion detecting apparatus for a wire dot head according to a first embodiment of the present invention.

FIG. 1 is a block diagram showing the wire motion detecting apparatus 10*c* for the wire dot head according to the first embodiment of the present invention. As shown in FIG. 2, the wire motion detecting apparatus 10*c* is connected both to the CPU 2*c* through the interface LSI 2*b* and to the sensor circuit 10*b*.

In FIG. 1, reference numeral 101 is a first counter that measures a motion time $T_S$. Reference numeral 102 is a second counter that measures a print time $T_P$. Reference numeral 103 is a third counter that measures a return time $T_R$. Reference numerals 104 to 106 are JK flip-flops corresponding to the counters 101 to 103, respectively. Reference numeral 107 is an NAND gate that inputs a printing trigger signal HDON and a printing pattern signal HDATA. An output signal of the NAND gate 107 is sent to each terminal LD of the counters 101 to 103.

An output signal of the NAND gate 107 is sent to an inverter 108. An output signal of the inverter 108 is sent to a terminal J of the JK flip-flop 104.

An output signal of a terminal RC of the counter 101 is sent to an inverter 111 and an AND gate 117. An output signal of the inverter 111 is sent to an AND gate 114. An output signal of the JK flip-flop 104 is sent to AND gates 114, 117, and 118. An output signal of the AND gate 114 is sent as an enable signal CT1EN to a terminal EN of the counter 101. Output signals of the AND gates 117 and 118 are sent to an OR gate 123. An output signal of the 0R gate 123 is sent to a terminal K of the JK flip-flop 104.

A first comparator output signal CMP is sent to the AND gate 118. An output signal of the AND gate 118 is sent to a terminal J of the JK flip-flip 105.

An output signal of the counter 102 is sent to the inverter 112 and an AND gate 119. An output signal of the inverter 112 is sent to the AND gate 115. An output signal of the JK flip-flop 105 is sent to AND gates 115, 119, and 120. An output signal of the AND gate 115 is sent as an enable signal CT2EN to a terminal EN of the counter 102. Output signals of the AND gates 119 and 120 are sent to an OR gate 124. An output signal of the OR gate 124 is sent to a terminal K of the JK flip-flop 105.

The first comparator output signal CMP is sent to an inverter 109. An output signal of the inverter 109 is sent to the AND gate 120.

An output signal of the AND gate 120 is sent to a terminal J of the JK flip-flop 106.

An output signal of a terminal RC of the counter 103 is sent to an inverter 113 and an AND gate 121. An output signal of the inverter 113 is sent to an AND gate 116. An output signal of the JK flip-flop 106 is sent to AND gates 116, 121, and 122. An output signal of the AND gate 116 is sent as an enable signal CT3EN to a terminal EN of the counter 103. Output signals of the AND gates 121 and 122 are sent to an OR gate 125. An output signal of the 0R gate 125 is sent to a terminal K of the JK flip-flop 106.

Figure 15:
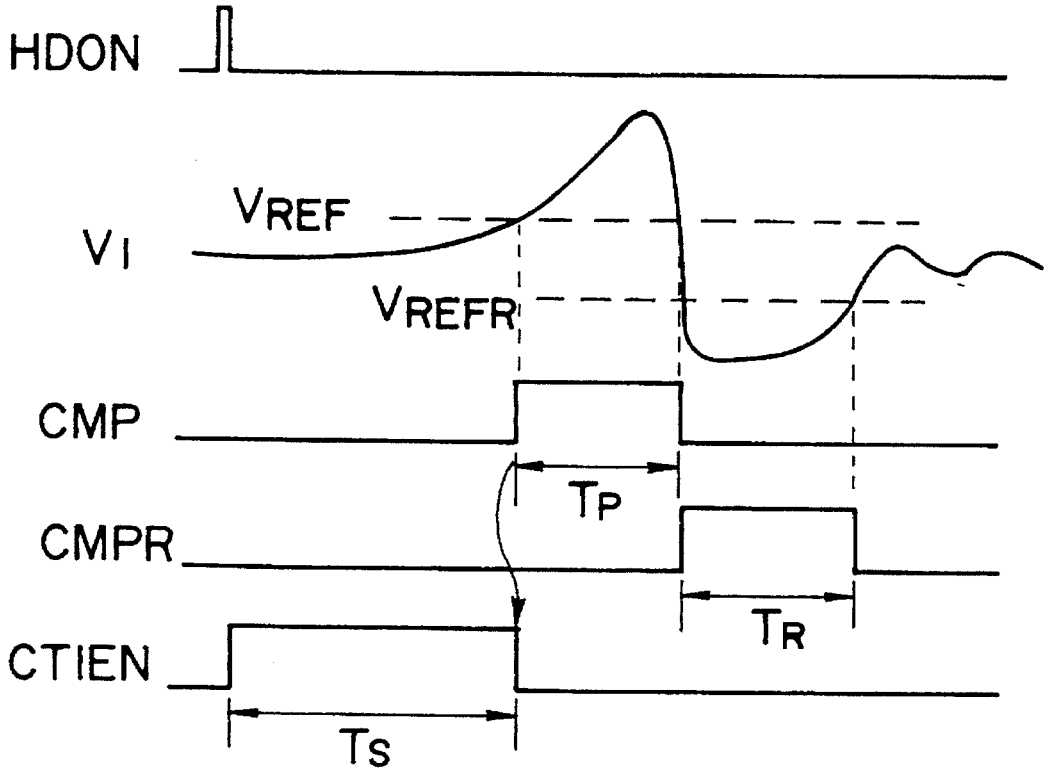
FIG. 15 is a timing chart in normal state of the wire motion detecting apparatus for the wire dot head according to an embodiment of the present invention.

A second comparator output signal CMPR is sent to the inverter 110. An output signal of the inverter 110 is sent to the AND gate 122. When the printer apparatus with the wire motion detecting apparatus 10*c* performs a print process, the CPU 2*c* of the control circuit 2 (see FIG. 2) outputs a printing trigger signal HDON and a printing pattern signal HDATA that cause the wire dot head 4 to be driven. At this point, a velocity wave form $V_1$ is output as shown in FIG. 15. The velocity wave form $V_1$ is compared with the reference voltage $V_{REF}$ and thereby the first comparator output signal CMP is generated. The velocity wave form $V_1$ is compared with the reference voltage $V_{REFR}$ and thereby the second comparator output signal CMPR is generated. The printing trigger signal HDON and the printing pattern signal HDATA are sent to the wire motion detecting apparatus 10*c* through the interface LSI 2*b*. The first comparator output signal CMP and the second comparator output signal CMPR are sent from the sensor circuit 10*b* to the wire motion detecting apparatus 10*c*.

The sensor circuit 10*b* has two comparators 56 (see FIG. 9) that generate the first comparator output signal CMP and the second comparator output signal CMPR. In FIG. 1, reference letter RST-N is a reset signal. Reference letter CLK is a clock. The signals RST-N and CLK are sent from the CPU 2*c* to the wire motion detecting apparatus 10*c* through the interface LSI 2*b*.

Next, the normal operation of the wire motion detecting apparatus 10*c* for the wire dot head will be described.

When the signal levels of the printing trigger signal HDON and the printing pattern signal HDATA become high, the signal level of the output signal of the NAND gate 107 becomes low. Thus, the count values of the counters 101 to 103 are set to "0". At this point, the signal level of the output signal of the JK flip-flop 104 becomes high and the signal level of the enable signal CT1EN, which is output from the AND gate 114, becomes high. Thus, the counter 101 starts counting.

When the signal level of the first comparator output signal CMP becomes high after a predetermined time period has elapsed, the counter 102 starts counting and the signal level of the enable signal CT1EN that is output from the AND gate 114 becomes low. Thus, the counter 101 stops counting and the count value at that point becomes the motion time $T_S$.

When the signal level of the first comparator output signal CMP becomes low after a predetermined time period has elapsed, the counter 102 stops counting and the count value at that time becomes the print time $T_P$.

When the signal level of the second comparator output signal CMPR becomes high, the counter 103 starts counting. When the signal level of the second comparator output signal CMPR becomes low after a predetermined time period has elapsed, the counter 103 stops counting. The count value at that time becomes the return time $T_R$.

When the print time $T_P$, the return time $T_R$, and the motion time $T_S$ are obtained, the control circuit 2 calculates the head gap g between the forward edge of the wire dot head 4 and the printing medium P (see FIG. 4) corresponding to the print time $T_P$, the return time $T_R$, and the motion time $T_S$. The wire dot head 4 is moved so that the head gap g becomes the proper value $g_R$. Next, with reference to FIG. 16, the operation of the wire motion detecting apparatus for the wire dot head upon occurrence of rebounding of the armature 32 (see FIG. 5) will be described.

Figure 16:
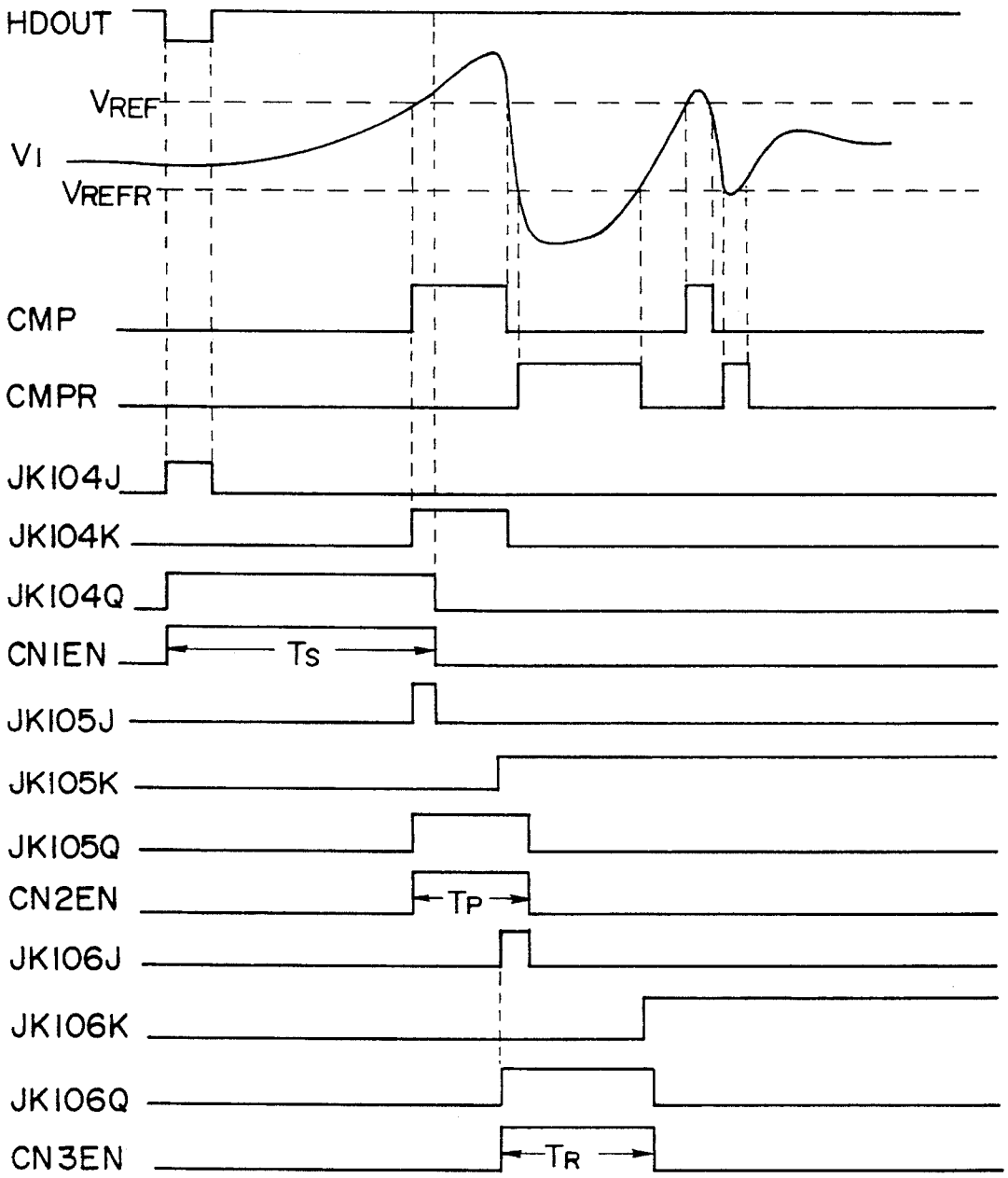
FIG. 16 is a timing chart of the wire motion detecting apparatus for the wire dot head upon occurrence of rebounding of an armature.

FIG. 16 is a timing chart upon occurrence of rebounding of the wire motion detecting apparatus for the wire dot head according to the first embodiment of the present invention.

In FIG. 16, when the signal levels of the printing trigger signal HDON and the printing pattern signal HDATA become high, the signal level of the output signal HDOUT of the NAND gate 107 becomes low. Thus, the count values of the counters 101 to 103 are set to "0". Consequently, the signal level of the output signal of the terminal RC of the counter 101 becomes low and the signal level of the input signal JK104J of the JK flip-flop 104 becomes high. At this point, since the signal level of the first comparator output signal CMP is low, the signal level of the input signal JK104K of the JK flip-flop 104 is low. Thus, since the signal level of the output signal JK104Q of the JK flip-flop 104 becomes high, the signal level of the enable signal CT1EN, which is output from the AND gate 114, becomes high and the counter 101 starts counting.

After a predetermined time period has elapsed, the signal level of the printing trigger signal HDON becomes low. Thus, the signal level of the input signal JK104J of the JK flip-flop 104 becomes low. However, until the signal level of the first comparator output signal CMP becomes high, the signal level of the output signal JK104Q of the JK flip-flop 104 is kept high and the counter 102 continues to count.

When the signal level of the first comparator output signal CMP becomes high after a predetermined time period has elapsed, the signal level of the AND gate 118 becomes high and the signal level of the input signal JK104K of the JK flip-flop 104, which is the output signal of the OR gate 123, becomes high. Thus, after the signal level of the CLK becomes high, the signal level of the output signal JK104Q of the JK flip-flop 104 becomes low. Consequently, the signal level of the enable signal CT1EN becomes low. As a result, the counter 101 stops counting.

Until the signal level of the first comparator output signal CMP becomes high and the signal level of the output signal JK104Q of the JK flip-flop 104 becomes low after the signal level of the CLK becomes high, the signal level of the AND gate 118 is kept high. Thus, the signal level of the input signal JK105J of the JK flip-flop 105 becomes high. At this point, since the signal level of the input signal JK105K of the JK flip-flop 105 is low, the signal level of the output signal JK105Q of the JK flip-flop 105 becomes high. Consequently, the enable signal CT2EN, which is output from the AND gate 115, becomes high and the counter 102 starts counting.

When the signal level of the CLK becomes high, the signal level of the output signal JK104Q of the JK flip-flop 104 becomes low and the signal level of the input signal JK105J of the JK flip-flop 105 becomes low. However, until the signal level of the first comparator output signal CMP becomes low and the signal level of the input signal JK105K of the JK flip-flop 105 becomes high, the signal level of the output signal JK104Q of the JK flip-flop 104 is kept high and the counter 102 continues to count.

When the signal level of the first comparator output signal CMP becomes low after a predetermined time period has elapsed, the signal level of the output signal of the AND gate 120 becomes high and the signal level of the input signal JK105K of the JK flip-flop 105, which is the output signal of the OR gate 124, becomes high. Thus, when the signal level of the CLK becomes high, the signal level of the output signal JK105Q of the JK flip-flop 104 becomes low and the signal level of the enable signal CT2EN becomes low. Thus, the counter stops counting.

Until the signal level of the first comparator output signal CMP becomes low and the signal level of the output signal JK105Q of the JK flip-flop 105 becomes low after the signal level of the CLK becomes high, when a high level signal is output from the AND gate 120, the signal level of the input signal JK106J of the JK flip-flop 106 becomes high. At this point, since the signal level of the input signal JK106K of the JK flip-flop 106 is low, the signal level of the output signal JK106Q of the JK flip-flop 106 becomes high. Thus, the signal level of the enable signal CT3EN, which is output from the AND gate 116, becomes high and the counter 103 starts counting.

When the signal level of the CLK becomes high, the signal level of the output signal JK105Q of the JK flip-flop 105 becomes low and the signal level of the input signal JK106J of the JK flip-flop 106 becomes low. However, until the signal level of the second comparator output signal CMPR becomes low and the signal level of the input signal JK106K of the JK flip-flop 106 becomes high, the signal level of the output signal JK106Q of the JK flip-flop 106 is kept high and the counter 103 continues to count.

When the signal level of the first comparator output signal CMP becomes low, since the velocity wave form $V_1$ of the printing wire 30 is going to become "0", thereafter the printing wires 30 are banged on the printing medium P (see FIG. 4) and then retreated.

Thus, just after the signal level of the first comparator output signal CMP becomes low, the signal level of the second comparator output signal CMPR becomes high.

When the signal level of the second comparator output signal CMPR becomes low after a predetermined time period has elapsed, the signal level of the output signal of the AND gate 122 becomes high and a high level signal is sent from the OR gate 125 to the terminal K of the JK flip-flop 106. Thus, the signal level of the enable signal CT3EN becomes low and the counter 103 stops counting.

The time period after the signal level of the first comparator output signal CMP becomes low until the signal level of the second comparator output signal becomes high is equal to the time period after the printing wires 30 are banged on the printing medium P until the velocity wave form $V_1$ of the printing wires 30 abruptly varies from a positive level to a negative level. Thus, since this time period is much shorter than the return time $T_R$, it can be omitted.

After the printing wires 30 start retreating, the armature 32 is attracted by the core 3*a* and thereby rebounded. The rebounding of the armature 32 causes the signal level of the first comparator output signal CMP become high. However, since the signal level of the output signal JK104Q of the JK flip-flop 104 is low at this time, the signal level of one input signal of the AND gate 118 is low. Thus, the signal level of the output signal of the AND gate 118 is kept low.

Consequently, since the signal level of the input signal JK105J of the JK flip-flop 105 is low and the signal level of the input signal JK104K is low, the signal level of the output signal JK105Q of the JK flip-flop 105 is kept low (at a former output value).

As a result, the signal level of the enable signal CT2EN does not become high and thereby the counter 102 does not start counting.

After a predetermined time period has elapsed, the printing wires 30 are rebounded and then retreated. In addition, the armature 32 is attracted by the core 32*a* and the signal level of the second comparator output signal CMPR becomes high. However, since the signal level of the output signal JK105Q of the JK flip-flop 105 is low at this time, the signal level of the output signal of the AND gate is kept low. Thus, since the signal level of the input signal JK106J of the JK flip-flop 106 is low and the signal level of the input signal JK106K is also low, the signal level of the output signal JK106Q of the JK flip-flop 106 is kept low (at the former output value).

Consequently, the signal level of the enable signal CT3EN does not become high and the counter 103 does not start counting.

Thus, with the counters 101 to 103, the motion time $T_S$, the print time $T_P$, and the return time $T_R$ can be measured corresponding to their count values. In the drawing, reference numeral $V_{REF}$ and $V_{REFR}$ are reference voltages.

Next, with reference to FIG. 17, the operation of the wire motion detecting apparatus for the wire dot head upon occurrence of a sensor failure will be described.

Figure 17:
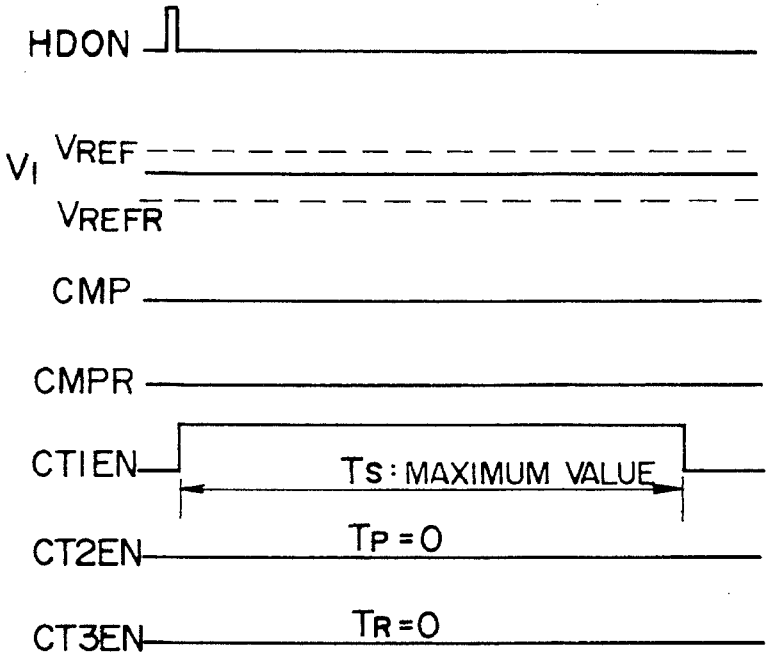
FIG. 17 is a timing chart of the wire motion detecting apparatus for the wire dot head upon occurrence of a sensor failure.

FIG. 17 is a timing chart of the wire motion detecting apparatus for the wire dot head upon occurrence of a sensor failure according to the first embodiment of the present invention.

In FIG. 1, when the signal levels of the printing trigger signal HDON and the printing pattern signal HDATA become high, the signal level of the output signal of the NAND gate 107 becomes low and the count values of the counters 101 to 103 are set to "0". At this point, the signal level of the output signal of the terminal RC of the counter 101 becomes low and the signal level of the output signal of the JK flip-flop 104 becomes high. Thus, the signal level of the enable signal CT1EN, which is output from the AND gate 114, becomes high and the counter 101 starts counting.

When a sensor failure takes place, the signal level of the first comparator output signal CMP does not become high even if a predetermined time period elapses. Thus, the count value of the counter 101 becomes maximum and the carry signal is output from the terminal RC.

Consequently, the inverter 111 outputs a low level signal and the signal level of the enable signal CT1EN, which is output from the AND gate 114, becomes low. Thus, the counter 101 stops counting. In addition, the signal level of the output signal of the AND gate 117 becomes high and the signal level of the output signal of the JK flip-flop becomes low.

Thus, since the signal level of one of the input signals of the AND gate 118 becomes low, the signal levels of the enable signals CT2EN and CT3EN, which are output from the AND gates 115 and 116, respectively, do not become high. Consequently, the count values of the counters 102 and 103 are kept "0".

When a sensor failure does not take place, the count value of the counter 101 does not become maximum. Thus, when the count value of the counter 101 becomes maximum, it is determined that a sensor failure has taken place. When a sensor failure takes place and thereby the count values of the counters 102 and 103 become maximum, it is determined that the sensor failure has taken place. In the drawing, reference letter $V_1$ is a velocity wave form. Reference letters $V_{REF}$ and $V_{REFR}$ are reference voltages. Reference letter CMPR is a second comparator output signal. Reference letter $T_S$ is a motion time. Reference letter $T_P$ is a print time. Reference letter $T_R$ is a return time.

Next, a second embodiment of the present invention will be described.

In the wire dot impact printer, a noise due to the driving of the wire dot head 4 (see FIG. 2) may take place in the velocity wave form $V_1$. In this case, the signal level of the first comparator output signal CMP becomes high corresponding to the intensity of the noise. When the signal level of the first comparator output signal CMP becomes high, since the moving of the printing wire 30 (see FIG. 5) has been just started, the velocity v of the printing wire 30 is low and gradually increased. Thus, since the slope of the velocity wave form $v_1$ is gentle, it is easily influenced by the noise.

Figure 14:
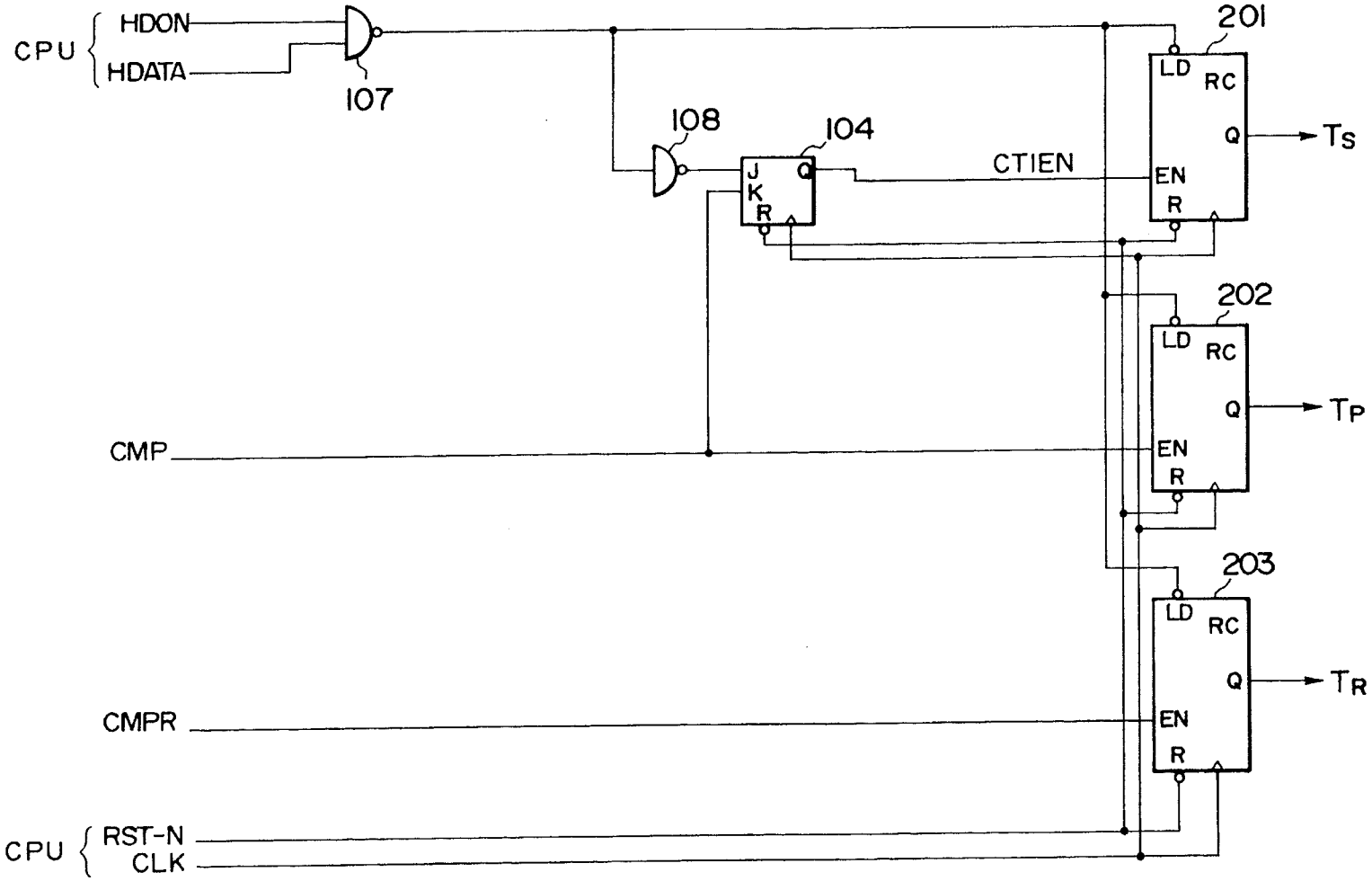
FIG. 14 is a circuit diagram showing a wire motion detecting apparatus for a wire dot head according to a related art reference.
Figure 18:
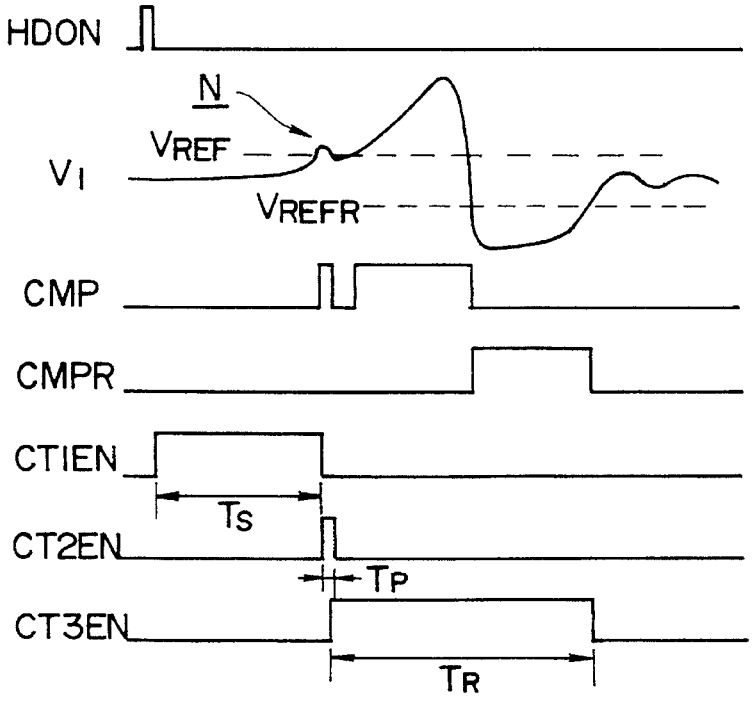
FIG. 18 is a timing chart of the wire motion detecting apparatus for the wire dot head according to the related art reference.
Figure 19:
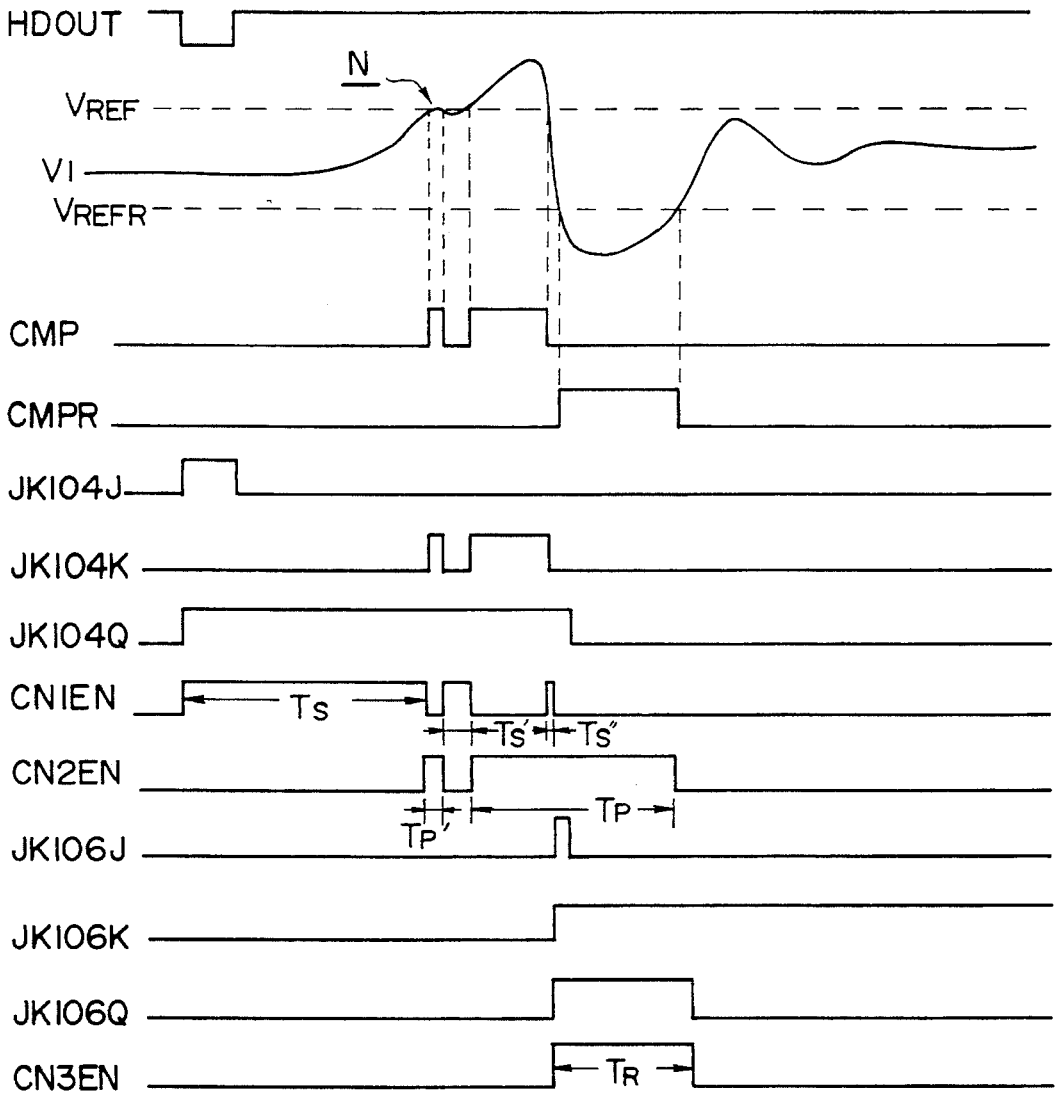
FIG. 19 is a timing chart of a wire motion detecting apparatus for a wire dot head according to a second embodiment of the present invention.
Figure 20:
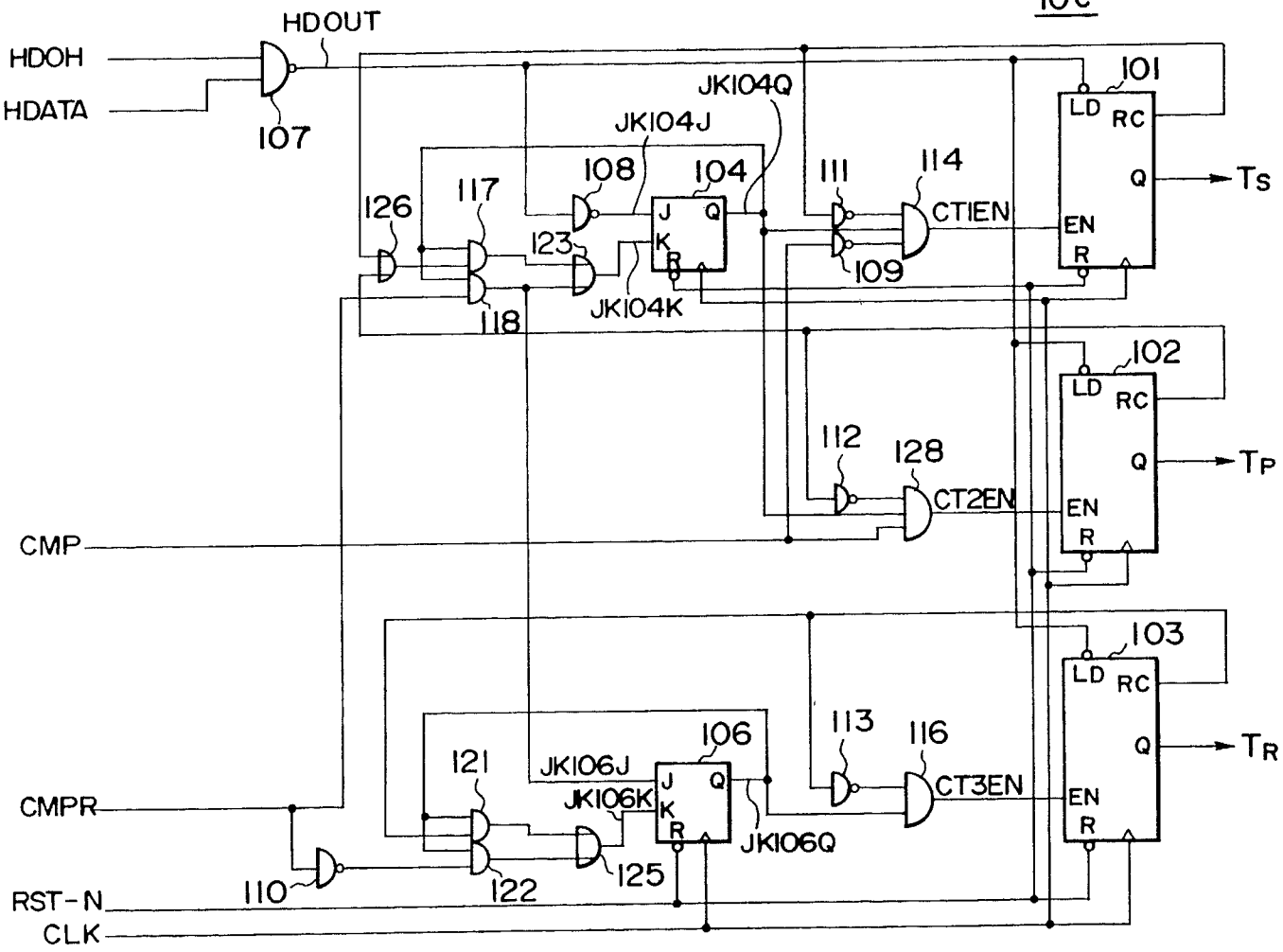
FIG. 20 is a block diagram showing the wire motion detecting apparatus for the wire dot head according to the second embodiment of the present invention.

FIG. 14 is a circuit diagram showing a wire motion detecting apparatus for a conventional wire dot head. FIG. 18 is a timing chart of the wire motion detecting apparatus for the conventional wire dot head. FIG. 19 is a timing chart of the wire motion detecting apparatus 10*c'* for the wire dot head according to the second embodiment of the present invention. FIG. 20 is a circuit diagram showing the wire motion detecting apparatus 10*c'* for the wire dot head according to the second embodiment of the present invention.

As shown in FIG. 18, in the conventional wire motion detecting apparatus, when the signal level of the first comparator output signal CMP becomes high for a short time period just before it is supposed to become high, the counter 201 (see FIG. 14) stops counting. Thus, the counter 202 counts for such a short time period. The counter 203 counts after the signal level of the first comparator output signal CMP becomes low until the signal level of the second comparator output signal CMPR becomes low.

Thus, the count values of the counters 201 to 203 become inaccurate. In the drawing, reference letter HDON is a printing trigger signal. Reference letters $V_{REF}$ and $V_{REFR}$ are reference voltages. Reference letters CT1EN, CT2EN and CT3EN are enable signals. Reference letter $T_S$ is a motion time. Reference letter $T_P$ is a print time. Reference letter $T_R$ is a return time.

As shown in FIG. 19, according to the second embodiment of the present invention, even if a noise N takes place in the velocity wave form $V_1$, the counters 101 and 102 count until the signal level of the second comparator output signal CMPR becomes high and whenever the signal level of the first comparator output signal CMP becomes high.

In FIGS. 19 and 20, reference numerals 101 to 103 are first to third counters, respectively. Reference numerals 104 and 106 are JK flip-flops. Reference numeral 107 is a NAND gate. Reference numerals 108 to 113 are inverters. Reference numerals 116 to 118, 121, 122, and 128 are AND gates. Reference numerals 123, 125, and 126 are OR gates. Reference letter RST-N is a reset signal. Reference letter CLK is a clock. Reference letters $V_{REF}$ and $V_{REFR}$ are reference voltages.

In this case, when the signal levels of the printing trigger signal HDON and the printing pattern signal HDATA become high, the output signal HDOUT of the NAND gate 107 becomes low and the count values of the counters 101 to 103 are set to "0". At this point, the output signal of the terminal RC of the counter 101 becomes low. In addition, since the signal level of the first comparator output signal CMP is low, the signal level of the input signal JK104J of the JK flip-flop 104 becomes high and the signal level of the signal JK104K thereof becomes low. Thus, the signal level of the output signal JK104Q of the JK flip-flop 104 becomes high.

Consequently, all the signal levels of the output signal JK104Q of the JK flip-flop 104, which is input to the AND gate 114, the output signal of the NOT gate 109, which inverts the first comparator output signal CMP, and the output signal of the NOT gate 111, which inverts the output signal of the terminal RC of the counter 101, become high. The signal level of the enable signal CT1EN, which is output from the AND gate 114, becomes high and the counter 101 starts counting.

When a noise N takes place in the velocity wave form $V_1$ after a predetermined time period has elapsed, the signal level of the first comparator output signal CMP becomes high for a short time period just before it is supposed to become high. At this point, the signal level of the enable signal CT1EN becomes low and the counter 101 stops counting.

In addition, the signal level of the enable signal CT2EN, which is output from the AND gate 128, becomes high and the counter 102 starts counting. When the noise N disappears and thereby the signal level of the first comparator output signal CMP becomes low, the signal level of the enable signal CT1EN becomes high and the counter 102 starts counting. Moreover, the signal level of the enable signal CT2EN becomes low and the counter 102 stops counting.

When the signal level of the first comparator output signal CMP becomes high with the normal sensor timing after a predetermined time period has elapsed, the signal level of the enable signal CT1EN becomes low and the counter 101 stops counting. At this point, the signal level of the enable signal CT2EN becomes high and the counter 102 starts counting again.

When the signal level of the first comparator output signal CMP becomes low after a predetermined time period has elapsed, the signal level of the enable signal CT1EN becomes high again. At this point, although the counter 101 starts counting, since the signal level of the second comparator output signal CMPR becomes high, the signal level of the AND gate 118 becomes high. A high level signal is sent from the OR gate 123 to the terminal K of the JK flip-flop 104. A low level signal is output from the flip-flop 104. Thus, the counter 101 immediately stops counting. On the other hand, the signal level of the enable signal CT2EN becomes low and the counter 102 stops counting.

Thereafter, the printing wires 30 (see FIG. 5) are banged on the printing medium P (see FIG. 4) and then retreated. Thus, just after the signal level of the first comparator output signal CMP becomes low, the signal level of the second comparator output signal CMPR becomes high.

Consequently, since the signal level of the output signal of the JK flip-flop 104 becomes low and the signal level of the enable signal CT1EN becomes low, the counter 101 stops counting. In addition, the signal level of the output signal of the JK flip-flop 106 becomes high. The signal level of the enable signal CT3EN, which is output from the AND gate 116, becomes high and the counter 103 starts counting.

When the signal level of the second comparator output signal CMPR becomes low after a predetermined time period has elapsed, the signal level of the input signal JK106K of the JK flip-flop becomes low and the signal level of the enable signal CT3EN becomes low. Thus, the counter 103 stops counting.

In other words, the counter 101 counts a motion time where a time $T_S'$ and a time $T_S''$ are added to the normal motion time $T_S$ as shown in FIG. 19. The counter 102 counts a print time where a print time $T_P'$ is added to the normal print time $T_P$. The counter 103 only counts the normal return time $T_R$.

In this case, the counter 101 counts a time that is by a time $T_P'$ shorter than that in the case that the noise N is absent. The counter 102 counts a time that is by a time $T_P'$ longer than that in such a case. However, since the time $T_P'$ is much shorter than the motion time $T_S$, the print time $T_P$, the return time $T_R$, and so forth, the time $T_P'$ can be omitted. This relation can apply to the time $T_S''$.

Thus, even if the noise N takes place, the motion time $T_s$, the print time $T_P$, and the return time $T_R$ can be precisely obtained.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

In other words, in the above-described embodiments, JK flip-flops have been used. However, they may be substituted with for example RS flip-flops.

According to the first aspect of the present invention, the wire motion detecting apparatus for the wire dot head comprises a velocity detecting means for detecting the velocity of a printing wire, a comparator output signal generating means for comparing a velocity wave form of the detected velocity with a reference voltage and for generating a first comparator output signal and a second comparator output signal, a first counter for measuring the motion time of the printing wire corresponding to a printing trigger signal and the first comparator output signal, a second counter for measuring the print time of the printing wire corresponding to the first comparator output signal and the second comparator output signal, and a third counter for measuring the return time of the printing wire corresponding to the second comparator output signal.

The wire motion detecting apparatus of the first aspect of the present invention further comprises a count stopping means for stopping the counting of the first counter when the signal level of the first comparator output signal is repeatedly changed between a high level and a low level.

After the printing wire is being retreated, an armature is attracted by a core and thereby rebounded. In this case, even if the rebounding of the armature causes the signal level of the first comparator output signal to be changed, the first counter does not start counting.

According to the second aspect of the present invention, the wire motion detecting apparatus for the wire dot head comprises a velocity detecting means for detecting the velocity of a printing wire, a comparator output signal generating means for comparing a velocity wave form of the detected velocity with a reference voltage and for generating a first comparator output signal and a second comparator output signal, a first counter for measuring the motion time of the printing wire corresponding to a printing trigger signal and the first comparator output signal, a second counter for measuring the print time of the printing wire corresponding to the first comparator output signal and the second comparator output signal, and a third counter for measuring the return time of the printing wire corresponding to the second comparator output signal.

The wire motion detecting apparatus of the second aspect further comprises a sensor failure detecting means for causing the count value of at least one of the counters to become maximum when at least one of the first comparator output signal and the second comparator output signal cannot be generated.

When a sensor failure takes place, even after a predetermined time period has elapsed, the signal level of the first comparator output signal is not changed. Thus, the counter value of the first counter becomes maximum and a carry signal is output from a terminal.

According to the third aspect of the present invention, the wire motion detecting apparatus for the wire dot head comprises a velocity detecting means for detecting the velocity of a printing wire, a comparator output signal generating means for comparing a velocity wave form of the detected velocity with a reference voltage and for generating a first comparator output signal and a second comparator output signal, a first counter for measuring the motion time of the printing wire corresponding to a printing trigger signal and the first comparator output signal, a second counter for measuring the print time of the printing wire corresponding to the first comparator output signal and the second comparator output signal, and a third counter for measuring the return time of the printing wire corresponding to the second comparator output signal.

The wire motion detecting apparatus of the third aspect further comprises a count repeating means for causing the first counter and the second counter to resume counting when the signal level of the first comparator output signal is repeatedly changed between a high level and a low level until the return time of the printing wire is measured by the third counter.

Thus, when a noise takes place in the velocity wave form and thereby the signal level of the first comparator output signal is repeatedly changed between a high level and a low level, the counting of the first counter and the second counter is resumed. When the signal level of the first comparator output signal is changed between a high level and a low level with a normal sensor timing, the first counter stops counting and the second counter starts counting.

What is claimed is:

1. A wire motion detecting apparatus for a wire dot head, comprising:

a first counter for measuring a motion time $T_S$ of a printing wire which is a time period after starting printing until the printing wire impacts on a printing medium;

a second counter for measuring a print time $T_P$ for which the printing wire is in contact with the printing medium;

a third counter for counting a return time $T_R$ of the printing wire which is a time period after separation from the printing medium until the printing wire is returned to a print waiting position;

a first control portion for controlling said first counter to start counting the motion time $T_S$ of the printing wire in response to a printing trigger signal and to stop counting in response to a first comparator output signal, the first comparator output signal being obtained by comparing a velocity wave form of the printing wire with a first reference voltage corresponding to a position where the printing wire impacts the printing medium;

a second control portion for controlling said second counter to start counting the print time $T_P$ in response to the first comparator output signal while said first counter is in operation and to stop counting in response to an absence of the first comparator output signal; and a third control portion for controlling said third counter to start counting the return time $T_R$ in response to the absence of the first comparator output signal and to stop counting in response to an absence of a second comparator output signal, the second comparator output signal being obtained by comparing the velocity wave form of the printing wire with a second reference voltage corresponding to the print waiting position in which the printing wire is waiting for print.

2. The wire motion detecting apparatus as set forth in claim 1, wherein said third control portion controls said third counter to start counting the return time $T_R$ in response to the absence of the first comparator output signal while said second counter is in operation.

3. The wire motion detecting apparatus as set forth in claim 1, wherein:

said first control portion comprises:

a first flip-flop circuit having first and second input terminals and being adapted for inputting the printing trigger signal at the first input terminal and for outputting a signal that causes said first counter to start counting; and an AND gate for inputting the output signal of said first flip-flop circuit and the first comparator output signal and for outputting an ANDed signal to the second terminal of said first flip-flop circuit; and said second control portion comprises:

a second flip-flop circuit having a first input terminal connected to an output terminal of said AND gate and being adapted for controlling a count operation of said second counter, said AND gate being adapted for outputting a high level signal when the signal level of the first comparator output signal becomes high while said first counter is in operation so that said first flip-flop circuit inputs the high level signal at the second input terminal thereof and said second flip-flop inputs the high level signal at the first terminal thereof to cause said second counter to start counting.

4. The wire motion detecting apparatus as set forth in claim 2, wherein:

said first control portion comprises:

a first flip-flop circuit having first and second input terminals and being adapted for receiving a printing trigger signal at the first input terminal and for outputting a signal that causes said first counter to start counting; and a first AND gate for receiving the output signal of said first flip-flop circuit and the first comparator output signal and for outputting an ANDed signal to the second terminal of said first flip-flop circuit;

said second control portion comprises:

a second flip-flop circuit having a first input terminal connected to an output terminal of said first AND gate and being adapted for controlling a count operation of said second counter; and a second AND gate for receiving an output signal of said second flip-flop circuit and an inverted first comparator output signal and for outputting an ANDed signal to the second terminal of said second flip-flop circuit; and said third control portion comprises:

a third flip-flop circuit having a first input terminal connected to an output terminal of said second AND gate and being adapted for controlling a count operation of said third counter; and a third AND gate for receiving an output signal of said third flip-flop circuit and an inverted second comparator output signal and for outputting an ANDed signal to the second terminal of said third flip-flop circuit, said first AND gate being adapted for outputting a first high level signal when the signal level of the first comparator output signal becomes high while said first counter is in operation and so that said first flip-flop circuit inputs the first high level signal at the second input terminal thereof and said second flip-flop inputs the first high level signal at the first terminal thereof to cause said second counter to start counting, and said second AND gate being adapted for outputting a second high level signal when the signal level of the first comparator output signal becomes low while said second counter is in operation so that said second flip-flop circuit inputs the second high level signal at the second input terminal thereof and said third flip-flop inputs the second high level signal at the first terminal thereof to cause said third counter to start counting.

5. The wire motion detecting apparatus as set forth in claim 1, wherein said first counter and said second counter are configured to output a carry signal when a count value becomes maximum; and the apparatus further comprises a count stop portion for detecting the carry signal output from at least one of the first and second counters and for causing the at least one counter to stop counting at a predetermined value.

6. The wire motion detecting apparatus as set forth in claim 4, wherein said first counter and said second counter are configured to output a carry signal when a count value becomes maximum; and said apparatus further comprises:

a sensor failure detecting portion, including:

a first inverter for inverting the carry signal from said first counter and a fourth AND gate having a first input terminal for receiving an output signal of said first inverter and a second input terminal coupled to a first trigger signal for causing said first counter to stop counting when either of the signals input to the input terminals of the fourth AND gate becomes low, and a second inverter for inverting the carry signal from said second counter and a fifth AND gate having a first terminal for receiving an output signal of said second inverter and a second terminal coupled to a second trigger signal for causing the second counter to stop counting when either of the signals input to the input terminal of the fifth AND gate becomes low.

7. The wire motion detecting apparatus as set forth in claim 6, wherein the first trigger signal is the output signal of said first flip-flop circuit, and the second trigger signal is the output signal of said second flip-flop.

8. The wire motion detecting apparatus as set forth in claim 5, wherein said count stop portion includes a first inverter having an input for receiving the carry signal from the first counter and an output coupled to the first counter for causing the first counter to stop counting in response to the carry signal from the first counter, and a second inverter having an input for receiving the carry signal from the second counter and an output coupled to the second counter for stopping the count of the second counter in response to the carry signal from the second counter.

9. A wire dot impact printer apparatus having a wire motion detecting apparatus for a wire dot head, said wire motion detecting apparatus comprising:

a first counter for measuring a motion time $T_S$ of a printing wire which is a time period after starting printing until the printing wire impacts on a printing medium;

a second counter for measuring a print time $T_P$ for which the printing wire is in contact with the printing medium;

a third counter for counting a return time $T_R$ of the printing wire which is a time period after separation from the printing medium until the printing wire is returned to a print waiting position;

a first control portion for controlling said first counter to start counting the motion time $T_S$ of the printing wire in response to a printing trigger signal and to stop counting in response to a first comparator output signal, the first comparator output signal being obtained by comparing a velocity wave form of the printing wire with a first reference voltage corresponding to a position where the printing wire impacts the printing medium;

a second control portion for controlling said second counter to start counting the print time $T_P$ in response to the first comparator output signal while said first counter is in operation and to stop counting in response to an absence of the first comparator output signal; and a third control portion for controlling said third counter to start counting the return time $T_R$ in response to the absence of the first comparator output signal and to stop counting in response to an absence of a second comparator output signal, the second comparator output signal being obtained by comparing the velocity wave form of the printing wire with a second reference voltage corresponding to a print waiting position in which the printing wire is waiting for print.

10. A wire motion detecting apparatus for a wire dot head, comprising:

a first counter for starting counting in response to a print trigger signal and for stopping counting in response to a first comparator output signal, the first comparator output signal being obtained by comparing a velocity wave form of a printing wire with a first reference voltage corresponding to a position where the printing wire impacts a printing medium, thereby measuring a motion time $T_S$ of the printing wire which is a time period after starting printing until the printing wire impacts the printing medium;

a second counter for starting counting in response to the first comparator output signal and for stopping counting in response to detection of an inverted value of the first comparator output signal, thereby measuring a print time $T_P$ for which the printing wire is in contact with the printing medium;

a third counter for starting counting in response to a second comparator output signal, the second comparator output signal being obtained by comparing the velocity wave form of the printing wire with a second reference voltage corresponding to a print waiting position where the printing wire is waiting for print, and for stopping counting in response to detection of an inverted value of the second comparator output signal, thereby counting a return time $T_R$ which is a time period after the printing wire is separated from the printing medium until the printing wire is returned to the print waiting position; and a count repeating portion for controlling the first and second counters to resume counting when the signal level of the first comparator output signal is repeatedly changed between a high level and a low level until said third counter measures the return time $T_R$ of the printing wire and not to resume counting when the signal level of the first comparator output signal is repeatedly changed between the high level and the low level after said third counter has measured the return time $T_R$ of the printing wire.

11. The wire motion detecting apparatus as set forth in claim 10, wherein said count repeating portion comprises:

a flip-flop circuit having a first input terminal and being adapted for outputting a high level signal when the printing trigger signal is input to the first input terminal thereof;

a first AND gate for receiving the output signal of said flip-flop circuit and the first comparator output signal through an inverter; and a second AND gate for receiving the output signal of such flip-flop circuit and the first comparator output signal;

wherein said count repeating portion is adapted for controlling the operation of said first counter in response to an output signal of said first AND gate and controlling the operation of said second counter in response to an output signal of said second AND gate.

12. A wire dot impact printer apparatus, comprising:

a first counter for receiving a printing trigger signal and a first comparator output signal that is obtained by comparing a velocity wave form of the printing wire of the printer head with a first reference voltage and for measuring a motion time of a printing wire in response to the printing trigger signal and the first comparator output signal;

a second counter for measuring a print time of the printing wire in response to the first comparator output signal;

a third counter for measuring a return time of the printing wire in response to the first comparator output signal and a second comparator output signal that is obtained by comparing the velocity wave form of the printing wire of the printer head with a second reference voltage; and a count repeating portion for resuming counting of said first counter and said second counter when the signal level of the first comparator output signal is repeatedly changed between a high level and a low level until said third counter measures a return time of the printing wire.

* * * * *